US007486306B2

(12) United States Patent
Tsujino et al.

(10) Patent No.: US 7,486,306 B2
(45) Date of Patent: Feb. 3, 2009

(54) OPTICAL WRITING DEVICE AND METHOD OF MANUFACTURING THE SAME

(75) Inventors: Kiyoshi Tsujino, Nagano-ken (JP); Yujiro Nomura, Nagano-ken (JP); Ken Ikuma, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 165 days.

(21) Appl. No.: 11/290,611

(22) Filed: Nov. 29, 2005

(65) Prior Publication Data

US 2006/0138305 A1 Jun. 29, 2006

(30) Foreign Application Priority Data

| | | |
|---|---|---|
| Nov. 29, 2004 | (JP) | 2004-343604 |
| Nov. 29, 2004 | (JP) | 2004-343605 |
| Dec. 3, 2004 | (JP) | 2004-350538 |
| Dec. 3, 2004 | (JP) | 2004-350539 |
| Dec. 3, 2004 | (JP) | 2004-350540 |

(51) Int. Cl.

| | |
|---|---|
| ***B41J 2/435*** | (2006.01) |
| ***B41J 2/455*** | (2006.01) |
| ***B41J 15/14*** | (2006.01) |
| ***G03G 15/04*** | (2006.01) |

(52) U.S. Cl. ..... 347/224; 347/233; 347/241; 399/220

(58) Field of Classification Search ..... 347/224, 347/233, 241; 399/220

See application file for complete search history.

(56) References Cited

U.S. PATENT DOCUMENTS

| | | | | |
|---|---|---|---|---|
| 4,801,950 | A * | 1/1989 | Frehling | 347/239 |
| 5,045,867 | A * | 9/1991 | Fuse | 347/256 |
| 6,137,518 | A * | 10/2000 | Maeda | 347/131 |
| 6,989,849 | B2 | 1/2006 | Nomura et al. | |
| 7,020,417 | B2 | 3/2006 | Nomura et al. | |
| 2003/0214571 | A1 * | 11/2003 | Ishikawa et al. | 347/255 |
| 2004/0125196 | A1 * | 7/2004 | Nomura et al. | 347/236 |

FOREIGN PATENT DOCUMENTS

| | | | |
|---|---|---|---|
| EP | 1388807 | A1 | 2/2004 |
| JP | 61270176 | A | 11/1986 |
| JP | 07-186444 | | 7/1995 |
| JP | 11-138899 | | 5/1999 |
| JP | 2001330910 | A | 11/2001 |
| JP | 2001357971 | A | 12/2001 |
| JP | 2002160397 | A | 6/2002 |
| JP | 2004066611 | A | 3/2004 |
| JP | 2004148630 | A | 5/2004 |

OTHER PUBLICATIONS

European Search Report for corresponding European application 05025969.6-1251 lists the references above.

* cited by examiner

*Primary Examiner*—Stephen D Meier
*Assistant Examiner*—Sarah Al-Hashimi
(74) *Attorney, Agent, or Firm*—Hogan & Hartson LLP

(57) ABSTRACT

A plurality of photo emitters are arrayed on a transparent substrate in a first direction to form at least one photo emitter array. An electrode is provided on the substrate and electrically connected to the photo emitters in common. A dimension of the electrode in a second direction perpendicular to the first direction is smaller than a dimension of the substrate in the second direction.

5 Claims, 35 Drawing Sheets

OPTICAL WRITING DEVICE AND METHOD OF MANUFACTURING THE SAME

BACKGROUND OF THE INVENTION

The present invention relates to an optical writing device serving as an exposer to be incorporated in an image forming apparatus, and a method of manufacturing such an optical writing device.

In a tandem or rotary-type image forming apparatus, it is know that an exposer is embodied by a scanning optical system or a photo emitter array (line head). In the latter case, alignment of photo emitters and lenses is required. For example, Japanese Patent Publication No. 7-186444A discloses that, in order to position an photo emitter array in which a plurality of photo emitters are arrayed and a monocular lens, a mark for indicating a central position of the lens is provided in a lens holder.

In such a line head, it is generally incorporated a one-to-one optical system using a rod lens array unit having two arrays of rod lenses 84 as shown in FIG. 31. In the rod lens array unit, it is necessary to align the photo emitters arrayed in a first direction X corresponding to the primary scanning direction in the scanning optical system with a center line C of the rod lens arrays, relative to a second direction Y corresponding to the secondary scanning direction in the optical scanning system (i.e., the direction that a photosensitive member serving as an image carrier is moved). But misalignment may occur.

In FIG. 31, A represents an example in which the photo emitter array is misaligned from the center line C by 0.1 mm, and B represents an example in which the photo emitter array is misaligned from the center line C by 0.2 mm. As such, when the photo emitter array is misaligned from the center line C of the rod lens arrays, a variation in light quantity occurs. FIG. 32A is a characteristic diagram showing a variation in light quantity in the first direction X, and FIG. 32B is a characteristic diagram showing light quantity profile data of a photo emitter in the second direction Y. As shown in FIG. 32B, when the photo emitter array is misaligned in the second direction Y, the variation in light quantity becomes symmetrical for positive and negative values of a misalignment amount.

In the example of FIG. 31, a diameter of the rod lens 84 is set to 0.56 mm. At this time, if the misalignment between the photo emitter array and the center line C of the rod lens arrays is zero, the variation in light quantity in the first direction X in FIG. 32A is distributed in such a way that a light quantity fluctuation cycle is 0.28 mm which is half of the diameter of the rod lens, like a characteristic Da. When the misalignment amount between them is 0.1 mm, the light quantity fluctuation cycle is the sum of 0.28 mm, which is half of the diameter of the rod lens, and 0.56 mm, which is the diameter of the rod lens. At this time, the light quantity fluctuation cycle is twice as large as that when the misalignment amount is zero. When the misalignment amount of them is 0.2 mm, the light quantity fluctuation cycle is 0.56 mm, which is the diameter of the rod lens.

As such, when the photo emitter array is misaligned from the center line C of the rod lens arrays 65, the following problems occur.

(1) The light quantity fluctuation cycle of light passing through the rod lens becomes large, and fluctuation in light quantity is easily perceived, such that image quality is conspicuously degraded.

(2) The fluctuation in light quantity of light passing through the rod lens is increased.

(3) The light quantity of light passing through the rod lens is reduced.

(4) Imaging performance is degraded, and a spot diameter becomes large or irregular.

In the line head disclosed in the above publication, a line head is fabricated by mounting LEDs serving as the photo emitters on a substrate. In such a case, the photo emitters would not be arranged linearly due to the mounting error, so it is difficult to align the center line of the lens arrays for all photo emitters. In addition, since fluctuation in light quantity of the photo emitter array itself is larger than fluctuation in light quantity of transmitted light of the lens array, in order to correct this problem, a light quantity correction control needs to be performed on each of the photo emitters on the basis of the light quantity of light passing through the lens array, and the fluctuation in light quantity of the photo emitter array itself and the fluctuation in light quantity of transmitted light of the lens array need to be corrected. Further, there is a problem in that the spot diameter cannot be corrected.

In a line head having a plurality of photo emitters, it is important to accurately align the center of the photo emitter with the center of the lens, but various problems may occur, as described above. As described above, in the line head using the LED described in the above publication, a method has been suggested in which marking to be detected is provided so as to indicate a center line for each photo emitter array and a central position for each lens.

In such a method in which marking is provided, the center of the photo emitter array and the center of the substrate are detected, and the position of each lens is adjusted such that the center of the lens is aligned with the centers of the photo emitter array and the substrate. In the method disclosed in the above publication, however, there is a problem in that, when a lens array is used, the adjustment cannot be performed for each lens. Further, in this method, since the central position is detected according to the shape of an electrode, there is a problem in that the shape of the electrode is limited.

Japanese Patent Publication No. 11-138899A discloses a tandem-type image forming apparatus capable of forming a full color image through the use of four colors of toner.

This apparatus incorporates a line head including a photo emitter array 61 in which a plurality of photo emitters 63 are arrayed on a single substrate as shown in FIG. 33. In such a line head, it is generally used a one-to-one optical system including a rod lens array in which a plurality of rod lenses 84 are arrayed.

In this figure, C denotes a center line of the rod lens array, and D denotes a diameter of the rod lens 84. Emergent light of the photo emitter 63 forms a light spot on a surface to be irradiated, such as an image carrier, via the rod lens 84 as shapes of light spots 5 and 6. Here, the light spot 5 has a normal shape having a diameter d, and the light spot 6 has a shape whose diameter is expanded to (d+a) in the first direction X.

The light spot 5 corresponds to a surface to be irradiated by the photo emitters arranged at positions distant from adjacent rod lenses, and the light spot 6 corresponds to a surface to be irradiated by the photo emitters arranged at positions in the vicinity of a boundary between adjacent rod lenses. As such, even when the photo emitters 63 have the same size, the shapes of the light spots in the first direction X are different from each other due to the relative positional relationship of the photo emitter 63 and the rod lens 84 in the first direction X, that is, the position of the rod lens in the first direction X through which emergent light of the photo emitter 63 passes.

The reason will be described with reference to FIG. 34. In FIG. 12A, a horizontal axis represents a distance in the first direction X, and a vertical axis represents a width s of a light spot in the first direction X. D denotes a diameter of the rod lens 84, as described with reference to FIG. 33, and corresponds to a cycle of a fluctuation profile G.

As shown in FIG. 34, in a portion of a bottom of the profile G, the shape of the light spot 5 has a diameter d. Further, in a portion of a top of the profile G, the diameter of the light spot 6 is expanded to (d+a). That is, the shapes of the light spots (spread shapes of light beams) in the first direction X are different from each other by a pitch of the diameter of the rod lens 84. As such, the spread shapes of the light beams in the first direction X are different from each other due to the relative positional relationship of the photo emitter 63 and the rod lens 84. Moreover, there is a problem in that, similarly, the shapes of the light spots (spread shapes of light beams) are different from each other by a pitch of a radius of the rod lens 84.

FIG. 35 is an explanatory view showing an example of the shape of a light spot when a color image is formed. The shapes of the light spots in one line in the first direction X for each color of cyan (C), magenta (M), yellow (Y), and black (K) are shown. As such, the shapes of the light spots of cyan (C) are formed to have different sizes in the first direction X.

For each color of magenta (M), yellow (Y), and black (K), light spots 5 having the normal size and light spots 6 having the large spread shape of the light beam are mixed. In addition, positions where the light spots 6 having the large width of the light beam are formed are different for the individual colors in the first direction X. For this reason, when the colors are superposed by the image forming apparatus described in the above publication so as to form a color image of plural colors, color fluctuation occurs, and image quality is degraded.

SUMMARY OF THE INVENTION

It is therefore an object of the invention to provide a method for manufacturing an optical writing device in which alignment between a photo emitter array and a rod lens array can be facilitated.

It is also an object of the invention to provide a method of manufacturing an optical writing device capable of preventing image quality from being degraded due to fluctuation in a light spot area caused by the relative positional relationship between a photo emitter and a rod lens in the first direction X.

In order to achieve the above objects, according to the invention, there is provided an optical writing device, comprising:

a transparent substrate;

a plurality of photo emitters, arrayed on the substrate in a first direction to form at least one photo emitter array; and an electrode, provided on the substrate and electrically connected to the photo emitters in common, wherein a dimension of the electrode in a second direction perpendicular to the first direction is smaller than a dimension of the substrate in the second direction.

A dimension of the substrate in the first direction may be larger than a dimension of the electrode in the first direction.

The photo emitters may be organic EL elements.

A plurality of photo emitter array may be arranged in the second direction.

The optical writing device may further comprise: a plurality of lenses, adapted to image light emitted from the photo emitters on a target surface, and arrayed in the first direction to form at least one lens array; and an adjuster, operable to align a center line of the at least one photo emitter array relative to the second direction with a center line of the at least one lens array relative to the second direction.

The dimension of the electrode in the second direction may be equal to or different from a dimension of the at least one rod lens array in the second direction.

According to the invention, there is also provided a method of manufacturing an optical writing device, comprising:

providing a transparent substrate on which a plurality of photo emitters are arrayed in a first direction to form at least one photo emitter array and an electrode is formed so as to be electrically connected to the photo emitters in common;

providing a plurality of lenses adapted to image light emitted from the photo emitters on a target surface, and arrayed in the first direction to form at least one lens array;

fixing the substrate and the lens array on a housing;

observing the lens array through the substrate;

detecting misalignment between a center line of the at least one photo emitter array and a center line of the at least one lens array relative to a second direction perpendicular to the first direction, based on at least one position of the observed electrode; and aligning the center line of the at least one photo emitter array with the center line of the at least one lens array, based on the detected misalignment.

The lens array may be observed by a CCD camera.

The lens array may be observed while emitting light from the photo emitters.

With the above configurations, the position of the lens array can be confirmed through the transparent substrate. For this reason, by setting the width of the common electrode for the photo emitters less than the width of the lens array relative to the second direction, the position of the lens array can be easily confirmed. Therefore, the position of the substrate can be simply adjusted, thereby improving the imaging performance.

According to the invention, there is also provided an optical writing device, comprising:

a transparent substrate;

a plurality of photo emitters, arrayed on the substrate in a first direction to form at least one photo emitter array; and a sealing member, provided on the substrate so as to cover the photo emitters, wherein a dimension of the sealing member in a second direction perpendicular to the first direction is smaller than a dimension of the substrate in the second direction.

A dimension of the substrate in the first direction may be larger than a dimension of the sealing member in the first direction.

The photo emitters may be organic EL elements.

A plurality of photo emitter arrays may be arranged in the second direction.

The optical writing device may further comprise: a plurality of lenses, adapted to image light emitted from the photo emitters on a target surface, and arrayed in the first direction to form at least one lens array; and an adjuster, operable to align a center line of the at least one photo emitter array relative to the second direction with a center line of the at least one lens array relative to the second direction.

The dimension of the sealing member in the second direction may be equal to or different from a dimension of the at least one rod lens array in the second direction.

According to the invention, there is also provided a method of manufacturing an optical writing device, comprising:

providing a transparent substrate on which a plurality of photo emitters are arrayed in a first direction to form at least one photo emitter array and a sealing member is provided so as to cover the photo emitters;

providing a plurality of lenses adapted to image light emitted from the photo emitters on a target surface, and arrayed in the first direction to form at least one lens array;

fixing the substrate and the lens array on a housing;

observing the lens array through the substrate;

detecting misalignment between a center line of the at least one photo emitter array and a center line of the at least one lens array relative to a second direction perpendicular to the first direction, based on at least one position of the observed sealing member; and aligning the center line of the at least one photo emitter array with the center line of the at least one lens array, based on the detected misalignment.

The lens array may be observed by a CCD camera.

The lens array may be observed while emitting light from the photo emitters.

With the above configurations, the position of the lens array can be confirmed through the transparent substrate. For this reason, by setting the width of the sealing member less than the width of the transparent substrate relative to the second direction, the position of the lens array can be easily confirmed. Therefore, the position of the transparent substrate can be simply adjusted, thereby improving the imaging performance.

According to the invention, there is also provided an optical writing device, comprising:

a transparent substrate;

a plurality of photo emitters, arrayed on the substrate in a first direction to form at least one photo emitter array;

an electrode, provided on the substrate and electrically connected to the photo emitters in common, the electrode having a first reflectivity; and a holder, supporting the substrate and having a second reflectivity which is different from the first reflectivity.

A dimension of the substrate in the first direction may be larger than a dimension of the electrode in the first direction.

The photo emitters may be organic EL elements.

A plurality of photo emitter arrays may be arranged in a second direction perpendicular to the first direction.

The optical writing device may further comprise: a plurality of lenses, adapted to image light emitted from the photo emitters on a target surface, and arrayed in the first direction to form at least one lens array; and an adjuster, operable to align a center line of the at least one photo emitter array relative to the second direction with a center line of the at least one lens array relative to a second direction perpendicular to the first direction.

The dimension of the electrode in the second direction may be equal to or different from a dimension of the at least one rod lens array in the second direction.

According to the invention, there is also provided a method of manufacturing an optical writing device, comprising:

providing a transparent substrate on which a plurality of photo emitters are arrayed in a first direction to form at least one photo emitter array and an electrode having a first reflectivity is formed so as to be electrically connected to the photo emitters in common;

fixing the substrate on a holder having a second reflectivity which is different from the first reflectivity; providing a plurality of lenses adapted to image light emitted from the photo emitters on a target surface, and arrayed in the first direction to form at least one lens array;

observing the electrode through the lens array;

detecting misalignment between a center line of the at least one photo emitter array and a center line of the at least one lens array relative to a second direction perpendicular to the first direction, based on at least one position of the observed electrode; and aligning the center line of the at least one photo emitter array with the center line of the at least one lens array, based on the detected misalignment.

The electrode may be observed by a CCD camera.

With the above configurations, since the reflectivity of the holder is set different from the reflectivity of the common electrode, the positions of the common electrode and the lens array can be easily confirmed. Therefore, the position adjustment of the center line of the lens array relative to the second direction can be simply performed on the basis of the center line of the photo emitter array which is formed on the transparent substrate. As such, since the misalignment of the lens array with respect to the photo emitter array due to a mounting error can be prevented from occurring, the imaging performance can be improved.

According to the invention, there is also provided an optical writing device, comprising:

a transparent substrate;

a plurality of photo emitters, arrayed on the substrate in a first direction to form at least one photo emitter array; and a plurality of lenses, adapted to image light emitted from the photo emitters on a target surface, and arrayed in the first direction to form at least one lens array, wherein:

the photo emitters include first photo emitters each having a first light emitting area and second photo emitters each having a second light emitting area which is different from the first light emitting area; and a position of the second photo emitter depends on a relative position in the first direction with respect to the rod lens array.

The second photo emitters may be arranged at an interval equal to a diameter or a half of the diameter of the lens.

The second light emitting area may be smaller than the first light emitting area.

A plurality of photo emitter arrays may be arranged in a second direction perpendicular to the first direction.

A plurality of lens arrays may be arranged in the second direction.

The photo emitters may be organic EL elements.

The first photo emitters and the second photo emitters may be embodied by common photo emitters each of which is capable of changing a light emitting area thereof.

With the above configurations, since the shapes of the light spots on the target surface are suppressed from being different from one another, fluctuation in imaging area can be reduced, a streak can be prevented from occurring, and image quality can be improved.

According to the invention, there is also provided an image forming apparatus, comprising:

a plurality of optical writing devices, each of which comprises:

a plurality of photo emitters, arrayed in a first direction to form at least one photo emitter array; and a plurality of lenses, adapted to image light emitted from the photo emitters on a target surface, and arrayed in the first direction to form at least one lens array; and an adjuster, operable to adjust a position of each of the optical writing devices in the first direction.

A plurality of photo emitter arrays may be arranged in a second direction perpendicular to the first direction.

A plurality of lens arrays may be arranged in the second direction.

The photo emitters may be organic EL elements.

According to the invention, there is also provided a method of manufacturing a color image forming apparatus incorporating a plurality of optical writing devices each of which comprises; a plurality of photo emitters, arrayed in a first direction to form at least one photo emitter array; and a plurality of lenses, arrayed in the first direction to form at least one lens array, the method comprising:

emitting light beams from the photo emitters;

causing the emitted light beams to pass through the at least one lens array to image light spots on a target surface;

observing the light spots on the target surface to obtain data indicative of a shape of each of the light spots;

determining first one of the light spots formed by first one of the optical writing devices as a reference spot, based on the obtained data;

determining second one of the light spots formed by second one of the optical writing devices which has a shape similar to the reference spot, based on the obtained data; and adjusting a position of the second one of the optical writing devices in the first direction such that the second one of the light spots is aligned with the first one of the light spots relative to the first direction.

The light spots may be observed by a CCD camera.

With the above configurations, the optical writing devices are positioned such that the light spots having the similar shape are arrayed relative to the first direction. Therefore, color fluctuation at the time of color superposition can be reduced, and thus image quality can be improved.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Embodiments of the invention will be described below in detail with reference to the accompanying drawings.

Figure 6:
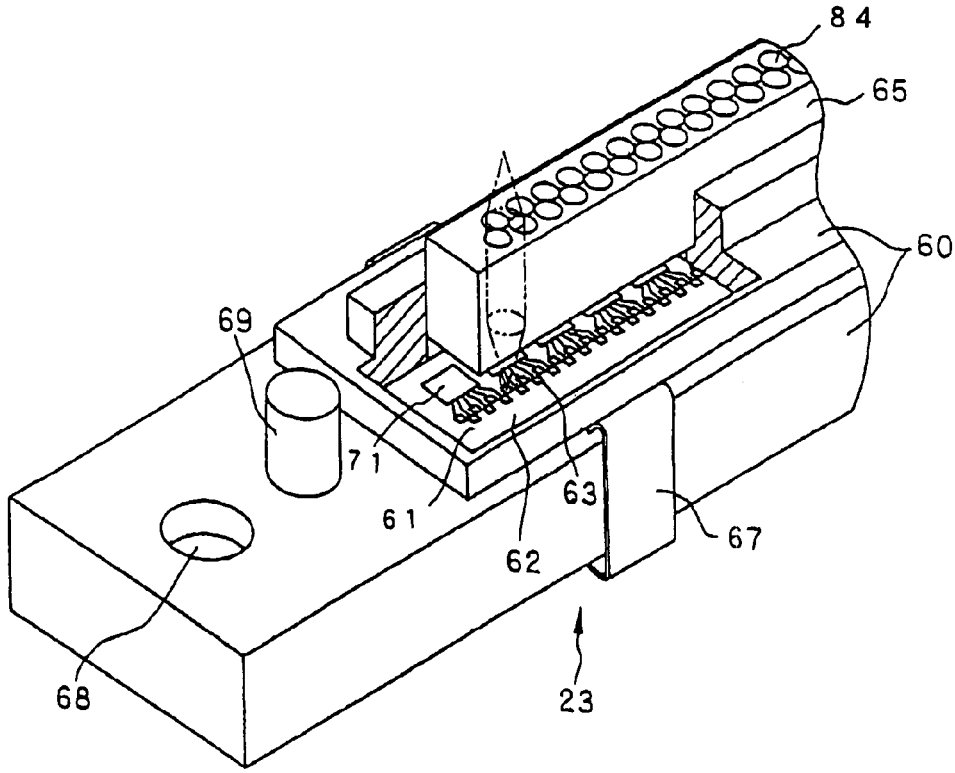
FIG. 6 is a perspective view of a part of the optical writing device.

FIG. 6 shows an optical writing device 23 according to a first embodiment of the invention. An photo emitter array 61 is held in an elongated housing 60. Positioning pins 69 provided at both ends of the elongated housing 60 are fitted into opposing positioning holes of a case 50 and fixing screws are screwed and fixed to screw holes of the case 50 via holes 68 provided at both ends of the elongated housing 60, such that the optical writing device 23 is fixed at a predetermined position.

In the optical writing device 23, photo emitters (organic-EL elements) 63 of the photo emitter array 61 are disposed on a glass substrate (transparent substrate) 62, and are driven by TFTs (thin film transistors) 71 which are formed on the same glass substrate 62. A rod lens array 65 forms an imaging optical system, in which gradient index-type rod lenses 84 are arranged in a zigzag manner in front of the photo emitters 63. Reference numeral 67 denotes a fixing plate spring. The housing 60 covers the sides of the glass substrate 62, and a side of the housing 60 facing an image carrier 20 opens. In such a manner, light beams are emitted from the rod lenses 84 to the image carrier 20. On the surfaces of the housing 60 facing end surfaces of the glass substrate 62, a light-absorbing member (coating material) is provided.

Figure 7:
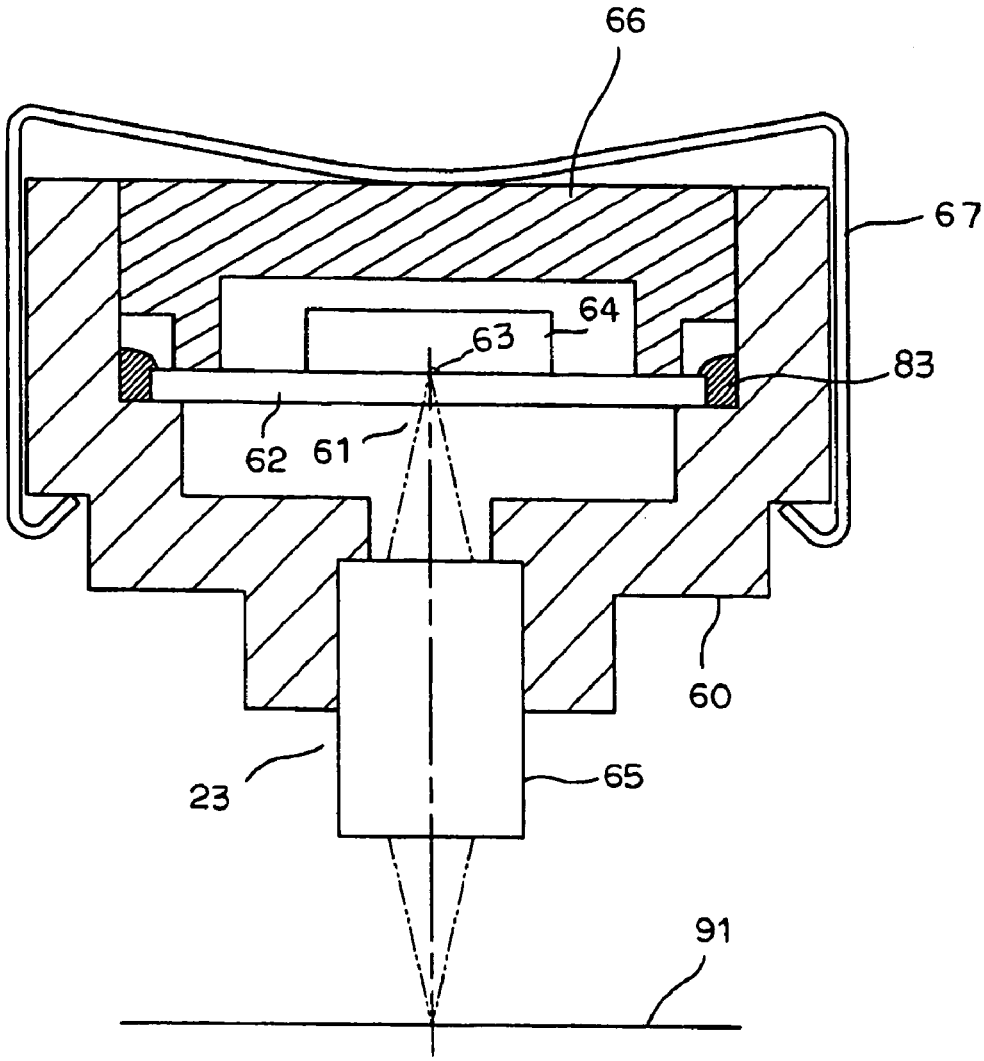
FIG. 7 is a section view of the optical writing device relative to a direction perpendicular to an arrayed direction of photo emitters.
Figure 8:
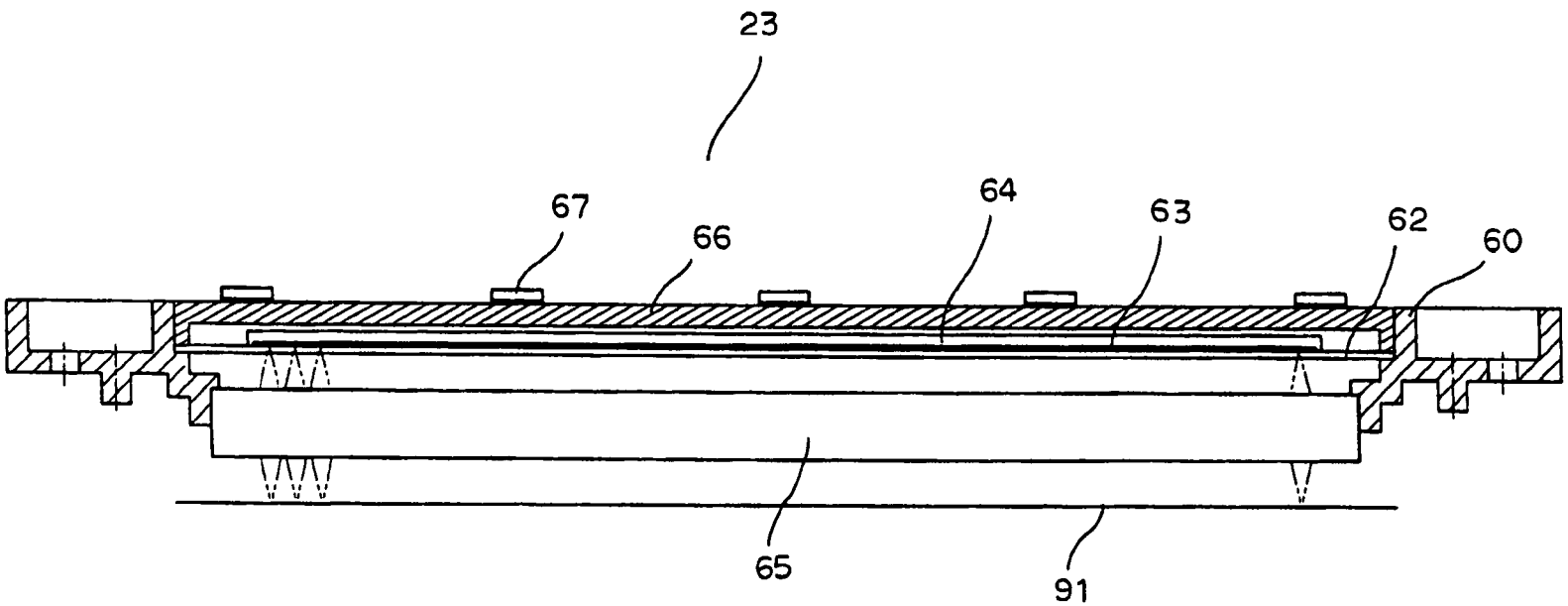
FIG. 8 is a section view of the optical writing device relative to the arrayed direction of the photo emitters.

As shown in FIGS. 7 and 8, the photo emitter array 61 that is attached to face the rear surface of the rod lens array 65 in the housing 60, and an opaque cover 66 that shields the photo emitter array 61 from the back surface of the housing 60 are provided. Further, the cover 66 is pressed on the back surface of the housing 60 by the fixing plate spring 67, such that the housing 60 is sealed in a light-tight manner. That is, the glass substrate 62 is optically sealed with the housing 60 by the fixing plate spring 67. A plurality of fixing plate springs 67 are provided in a longitudinal direction of the housing 60. Reference numeral 91 denotes an image surface (a surface to be irradiated) which is formed on the image carrier.

If the inner surface of the case is coated with a black coating material which absorbs ultraviolet rays, an ultraviolet shield effect for the photo emitter array 61 can be more reliably performed, and the organic EL elements can be prevented from being degraded. Further, the housing 60 of the optical writing device 23 is formed of an opaque member, and the back surface thereof is covered with the nontransparent cover 66. For this reason, ultraviolet rays from a fluorescent lamp or the sun, which are incident on the back surface of the photo emitter array 61, are also prevented from reaching the photo emitters 63 of the photo emitter array 61. Reference numeral 83 denotes an adhesive that fixes the glass substrate 62 to the housing 60.

The glass substrate 62 includes a cover glass 64 for covering the photo emitters 63. Such a glass substrate 62 is fixed to the housing 60. At this time, the glass substrate 62 is positioned for the position of the photo emitter 83 and the center of the rod lens array 65. The glass substrate 62 is covered with the cover 66, and the cover 66 is fixed by the plate springs 67.

Figure 9:
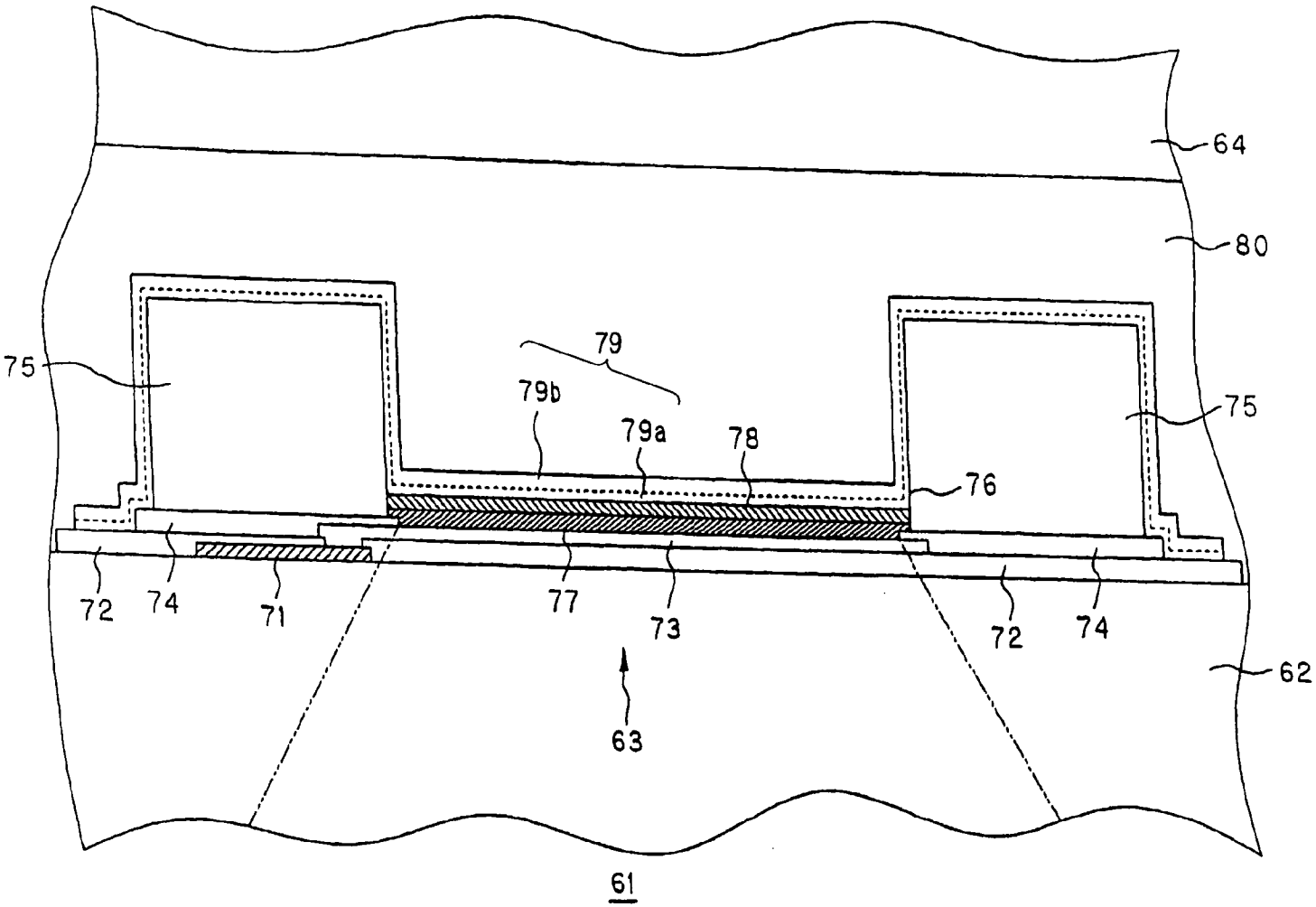
FIG. 9 is an enlarged section view of one of the photo emitters.

FIG. 9 shows the configuration in the vicinity of the photo emitter 63 of the photo emitter array 61. In the photo emitter array 61, TFTs 71 formed of polysilicon having a thickness of 50 nm are provided in a marginal portion of the glass substrate 62 having a thickness of 0.5 mm corresponding to two arrays of photo emitters 63 arranged in a zigzag manner so as to control emission of the photo emitters 63. On the glass substrate 62, an insulating film 72 formed of $SiO_2$ having a thickness of about 100 nm is formed, excluding a contact hole on the TFT 71. An anode 73 formed of ITO having a thickness of 150 nm is formed at a position of the photo emitter 63 so as to be connected to the TFT 71 via the contact hole.

Next, an additional insulating film 74 formed of $SiO_2$ having a thickness of about 120 nm is formed in a portion corresponding to a position other than the photo emitter 63, and a partition wall 75 formed of polyimide having a thickness 2 μm is formed thereon, in which a hole 76 is formed corresponding to the photo emitter 63. In the hole 76 of the partition wall 75, a hole injecting layer 77 having a thickness of 50 nm, and a light-emitting layer 78 having a thickness of 50 nm are sequentially formed from the anode 73. A cathode electrode 79 serving as a common electrode includes a first cathode layer 79*a* and a second cathode layer 79*b*. The first cathode layer 79*a* formed of Cu having a thickness of 100 nm and the second cathode layer 79*b* formed of Al having a thickness of 200 nm are sequentially formed so as to cover the upper surface of the light-emitting layer 78, the inner surface of the hole 76, and the outer surface of the partition wall 75.

Next, the hole 76 is covered with the cover glass 64 having a thickness of about 1 mm with an inert gas 80, such as nitrogen gas or the like to complete the photo emitter 63. Emission from the photo emitter 63 is performed toward the glass substrate 62. Moreover, as a material for the light-emitting layer 78 and a material for the hole injecting layer 77, various known materials can be used, and the detailed descriptions thereof will be omitted. Since such organic EL elements can be easily manufactured on the glass substrate, manufacturing costs can be reduced.

Next, a method for manufacturing the optical writing device 23 will be explained.

Figure 10A:
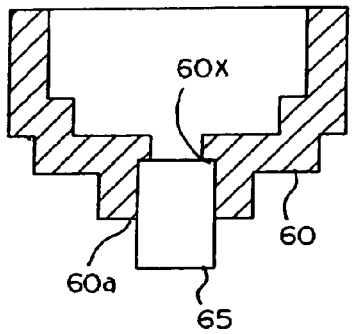
FIGS. 10A to 10D are section views for explaining the manufacturing method of the optical writing device.
Figure 10B:
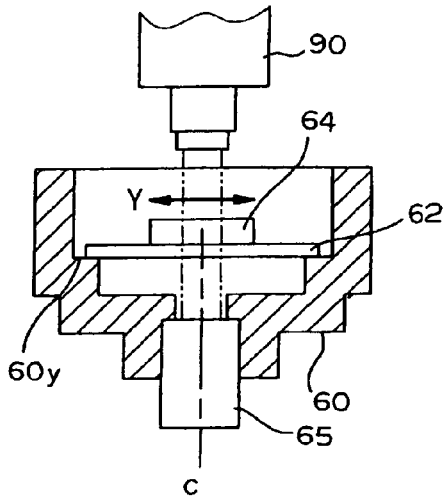

As shown in FIG. 10A, the rod lens array 65 is inserted into an opening 60*a* formed in a central portion of the housing 50, and a front end of the rod lens array 65 is anchored to a step portion 60*x* provided in the opening 60*a*, such that the rod lens array 65 is fixed to the housing 60. Next, as shown in FIG. 10B, the photo emitter (not shown) mounted on the glass substrate 62 is sealed by the cover glass 64, and the glass substrate 62 is inserted into the housing 60 and is disposed on a step portion 60*y* formed in the housing 60.

Figure 10C:
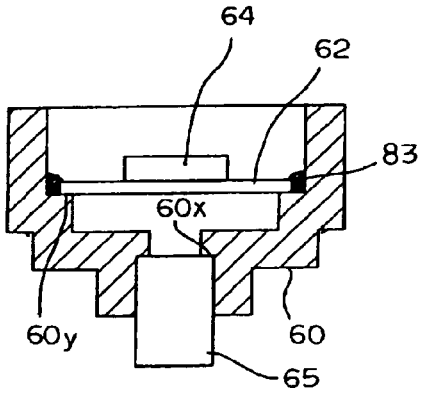
Figure 10D:
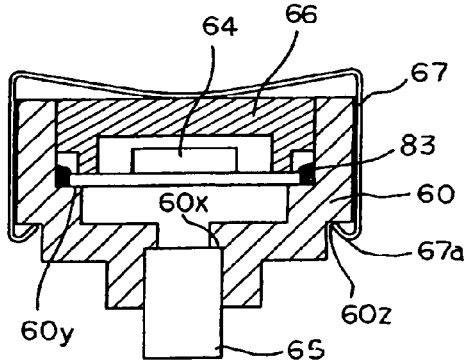

In this state, misalignment between the position of the photo emitter mounted on the glass substrate 62 and the center line C of the rod lens array 65 is detected by the CCD camera 90, and then the glass substrate 62 is positioned by a position adjuster described below. At this time, the glass substrate 82 is moved in the second direction Y and is positioned. If positioning is completed, as shown in FIG. 10C, the glass substrate 62 is fixed to the housing 60 by the adhesive 83. Next, as shown in FIG. 10D, the cover 66 is adhered and pressed by the fixing plate springs 67, such that hook portions 67*a* formed at front ends of the individual fixing plate springs 67 are anchored to a step portion 60*z* formed in an outer portion of the housing 60. The housing 60 serves as a holder of the rod lens array 65.

Figure 11:
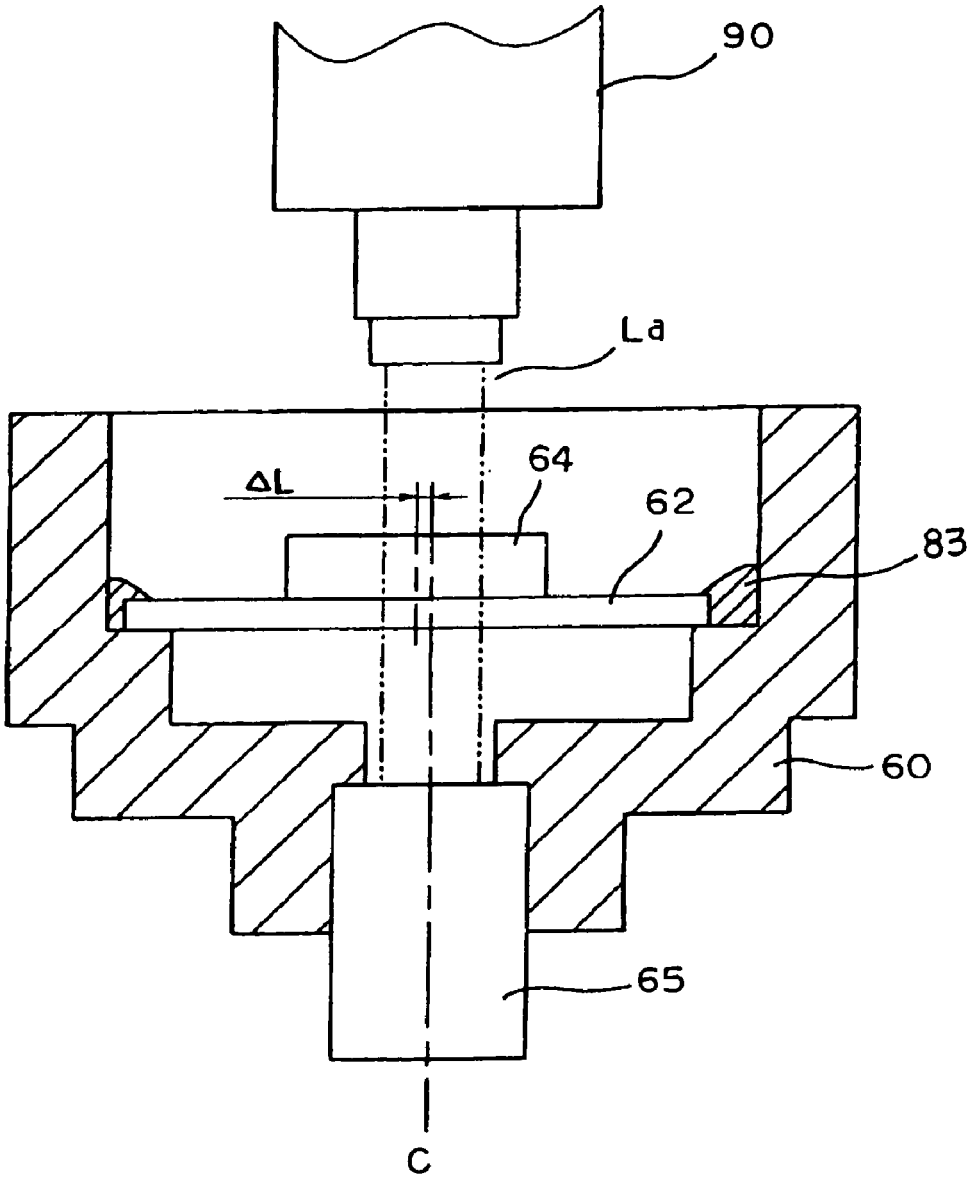
FIG. 11 is a section view for explaining alignment between the photo emitters and rod lenses.

A method of detecting the misalignment will be described in detail with reference to FIG. 11. Supposing a case where the center position of the photo emitter 63 formed on the glass substrate 62 is misaligned from the center line C of the rod lens array 65 by ΔL, this misalignment is detected by the CCD camera 90. La denotes an optical path of the CCD camera 90. The misalignment amount detected by the CCD camera 90 is stored in a memory 103 shown in FIG. 13.

Figure 12:
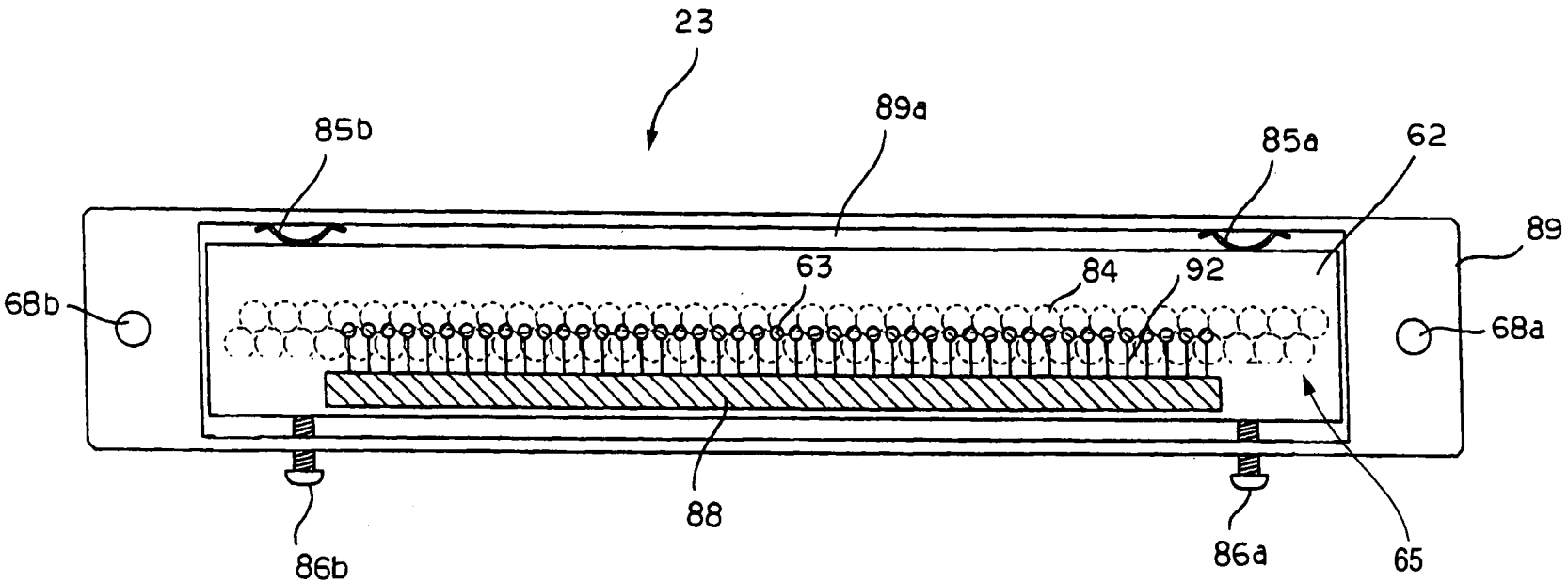
FIG. 12 is a plan view of a mechanism for performing the alignment.

In order to fix the optical writing device 23 to a body of an image forming apparatus, holes 68*a* and 68*b* are provided at both ends of a base 89 as shown in FIG. 12. In this embodiment, two arrays of the rod lenses 84 are arranged in the second direction Y.

In a central portion of the base 89, an opening 89*a* is formed, and the glass substrate 62 is inserted into the opening 89*a*. At one edge of the opening 89*a* in a longitudinal direction, plate springs 85*a* and 85*b* are provided.

With the plate springs 85*a* and 85*b*, one edge of the glass substrate 62 in the longitudinal direction is pressed. Next, by the above-described CCD camera 90, the center line C of the rod lens arrays 65 is observed, the glass substrate 62 is moved in the second direction Y while adjusting screws 86*a* and 86*b* are adjusted and is positioned with respect to the center line C of the rod lens arrays 65.

Moreover, at this time, the misalignment amount between the photo emitter 63 and the center line C of the rod lens arrays 65 is detected by the CCD camera 90, and thus data for light quantity correction can be acquired. When the light quantity correction is performed, the position adjustment of the glass substrate 62 shown in FIG. 12 is not performed. The light quantity correction is performed by an electrical unit in which a voltage or a current of the photo emitter 63 is controlled by the configuration shown in FIG. 13.

Figure 13:
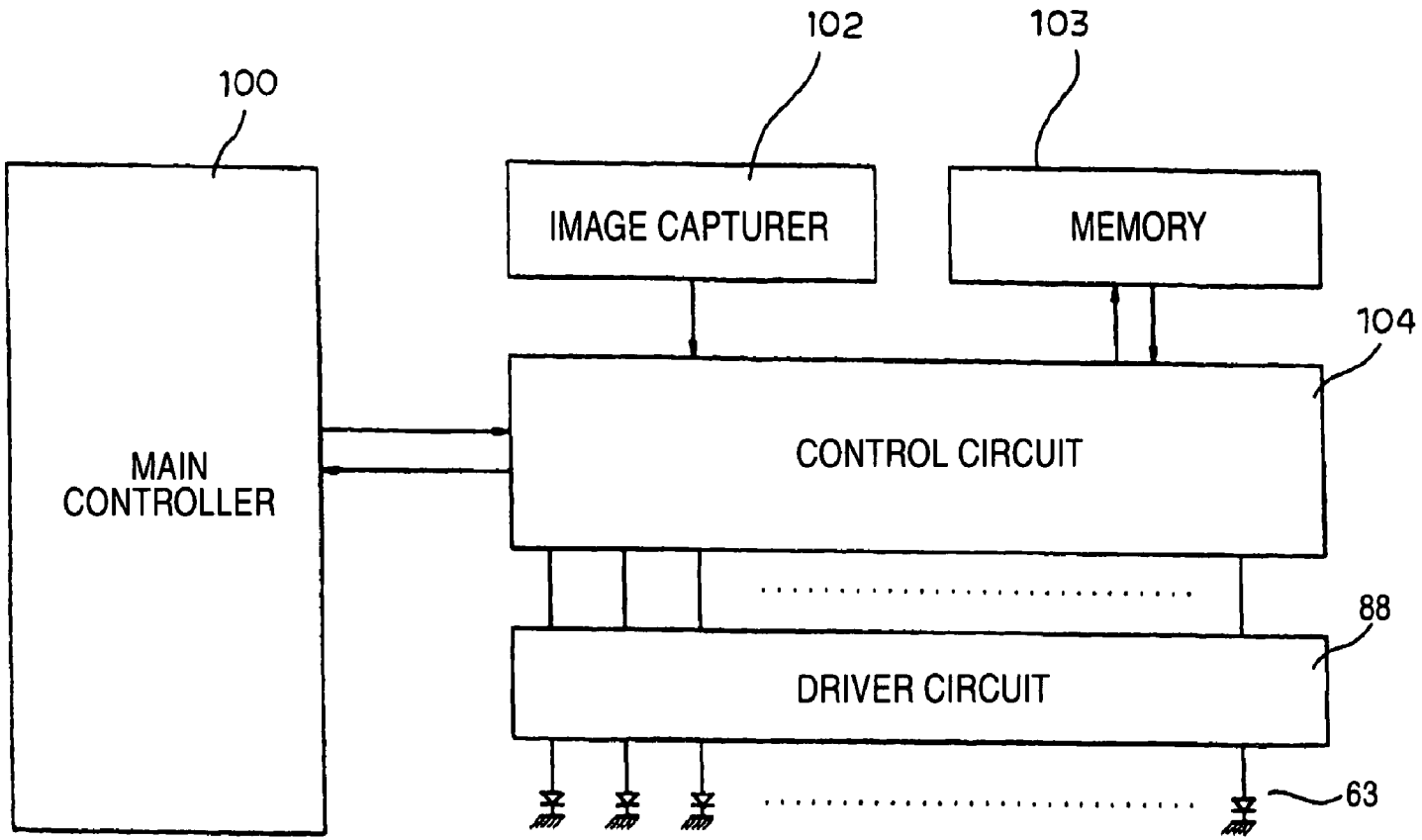
FIG. 13 is a block diagram showing a system for performing the alignment.

FIG. 13 is a block diagram showing the schematic configuration of a control unit of the optical writing device. In FIG. 13, reference numeral 102 denotes a misalignment detector, reference numeral 103 denotes a memory, reference numeral 104 denotes a control circuit, reference numeral 105 denotes a driving circuit having a TFT, and reference numeral 106 denotes a photo emitter in which a plurality of photo emitters are arranged in one line (first direction X).

Specifically, a main controller 100 generates print data and transmits print data to a control circuit 104 of the line head. An image capturer 102 corresponding to the CCD camera 90 detects the above-described misalignment. The memory 103 stores the misalignment amount detected by the image capturer 102.

The control circuit 104 reads out the characteristic of the misalignment amount detected by the image capturer 102 from the memory 103, and calculates the misalignment between the center of the photo emitter 63 and the center line C of the rod lens arrays 65. Further, the control circuit 104 transmits a signal to the driver circuit 88, and controls a voltage or a driving current applied to the photo emitter 63.

When the organic EL element is used for the photo emitter of the optical writing device, the photo emitter array is fabricated on a single substrate by use of a semiconductor process, and thus linearity of the array can be realized with high precision, as compared with a case where the LED is used as the photo emitter. In addition, if fluctuation in light quantity of the photo emitter itself is smaller than fluctuation in light quantity of transmitted light of the lens array, and the center line of the lens array and the photo emitter array are positioned with high precision, the light quantity can be made uniform without correcting the light quantity, and a light spot diameter can be made uniform. For this reason, a high-quality line head can be obtained. Paying attention to such characteristics of the organic EL element, the present invention detects the misalignment of the optical writing device.

As such, in the optical writing device 23 in which a plurality of organic EL elements, which can be manufactured with favorable linearity for a manufacturing process, are arrayed so as to form the photo emitter array 61, the misalignment is detected on the basis of the center line C of the rod lens arrays 65 which has a small mounting error for the housing 60. For this reason, the misalignment of the photo emitter 63 relative to the rod lens arrays 65 can be detected with high precision, and thus the glass substrate 62 can be accurately aligned.

Further, the detection of the misalignment between the rod lens arrays 65 and the glass substrate 62 (the photo emitters 63) is performed by observing the rod lens arrays 65 from the rear side of the glass substrate 62 (a side opposite to a side from which light beams is emitted from the photo emitters 63). For this reason, the positions of the rod lens arrays 65 and the glass substrate 62 can be observed without being influenced by the emitted light of the photo emitters 63, and thus the detection of the misalignment between them can be easily performed with high precision.

Figure 1:
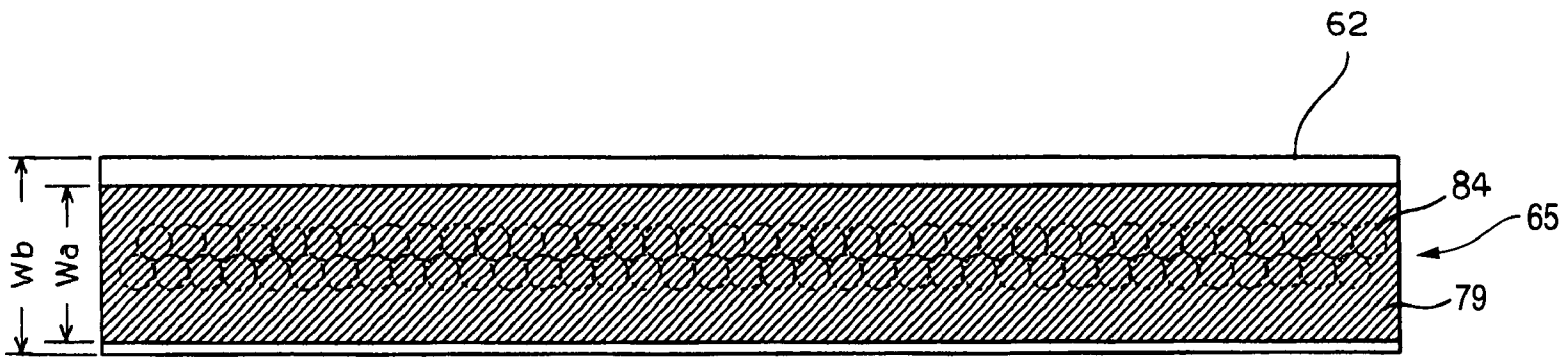
FIG. 1 is a schematic plan view for explaining a manufacturing method of an optical writing device according to a first embodiment of the invention.

More specifically, as shown in FIG. 1, the rod lens 84 is observed by the CCD camera 50 through the glass substrate 62. A width Wa of a cathode electrode 79, which serves as the common electrode for the plurality of photo emitters 63, is formed narrower than a width Wb of the glass substrate 62. For this reason, the light quantity of light, which passes through the transparent glass substrate 62, not being blocked by the cathode electrode 1, is increased, and thus the detection of the center line C of the rod lens arrays 65 can be facilitated.

At this time, since the edges on both sides of the cathode electrode 79 are also detected by the CCD camera 90, the misalignment between the position of the center line C of the rod lens arrays 65 and the photo emitter array 61 can be calculated. Therefore, by use of the adjusting screws 86*a* and 86*b* and the plate springs 85*a* and 85*b* described with reference to FIG. 12, the position of the glass substrate 62 in the second direction Y can be adjusted, and the alignment between the position of the center line C of the rod lens arrays 65 and the center position of the photo emitter array 61 can be performed.

Figure 2:
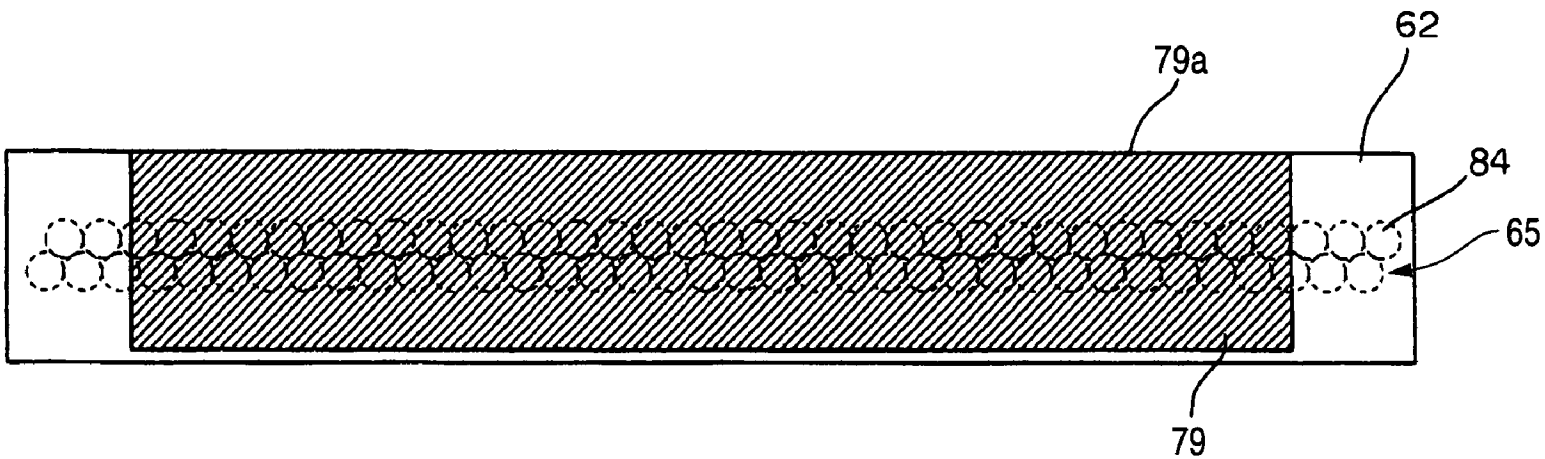
FIG. 2 is a schematic plan view for explaining a manufacturing method of an optical writing device according to a second embodiment of the invention.

Next, a second embodiment of the invention will be described with reference to FIG. 2. Similar components to those in the first embodiment will be designated by the same reference numerals, and repetitive explanations for those will be omitted.

In this embodiment, a width in the second direction Y of a cathode electrode 79 is almost equal to the width of the glass substrate 62, and one edge 79*a* of the cathode electrode 79 is aligned with the edge of the glass substrate 62 Further, a length of the cathode electrode 79 in the first direction X is made shorter than a length of the glass substrate 62. In this embodiment, the position of the center line C of the rod lens arrays 65 can be detected by the CCD camera 90 with light passing through both ends of the glass substrate 62.

Further, the cathode electrode 79 is also detected by the CCD camera 90. In this embodiment, the misalignment between the position of the center line C of the rod lens arrays 65 and the photo emitter array 61 can be calculated, and the alignment between the position of the center line C of the rod lens arrays 65 and the center position of the photo emitter array 61 can be performed by use of the mechanism shown in FIG. 12.

Figure 3:
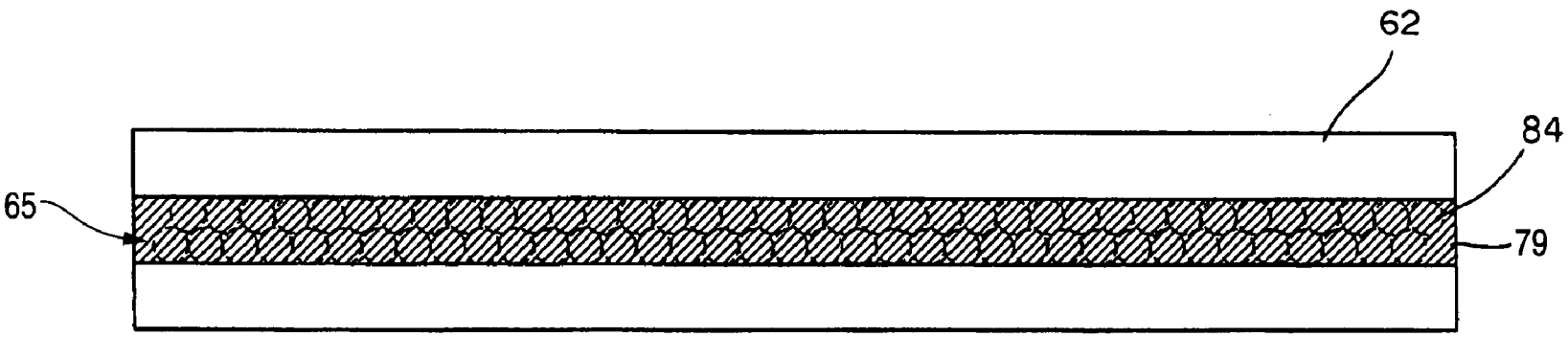
FIG. 3 is a schematic plan view for explaining a manufacturing method of an optical writing device according to a third embodiment of the invention.

Next, a third embodiment of the invention will be described with reference to FIG. 3. Similar components to those in the first embodiment will be designated by the same reference numerals, and repetitive explanations for those will be omitted.

In this embodiment, a width in the second direction Y of a cathode electrode 79 is equal to a width of the rod lens arrays 65. When both edges of the cathode electrode 79 are detected by the CCD camera 90, the width of the rod lens arrays 65 is also detected. In this case, half of the width of the cathode electrode 79 becomes the center line C of the rod lens arrays 65, and thus a processing for calculating the misalignment between the position of the center line C of the rod lens arrays 65 and the photo emitter array 61 can be simplified.

Figure 4:
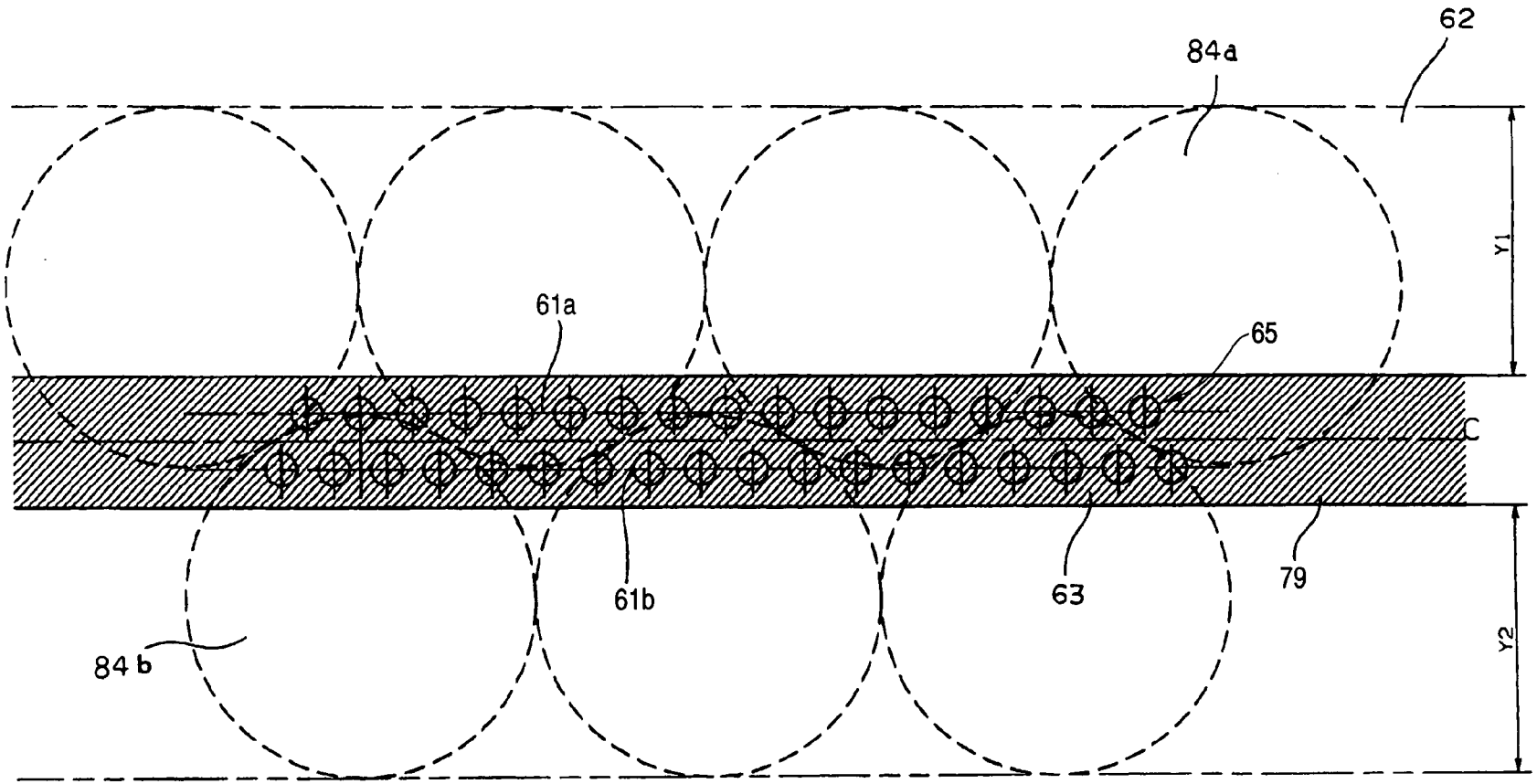
FIG. 4 is a schematic plan view for explaining a manufacturing method of an optical writing device according to a fourth embodiment of the invention.

Next, a fourth embodiment of the invention will be described with reference to FIG 4. Similar components to those in the first embodiment will be designated by the same reference numerals, and repetitive explanations for those will be omitted.

In this embodiment, a width of a cathode electrode 79 is made narrower than a width of each of rod lenses 84*a* and 84*b*. The glass substrate 62 is partially shown. Reference numerals 61*a* and 61*b* denote photo emitter arrays in which a plurality of photo emitters 63 are arrayed in the first direction X. Y1 denotes a length between one edge of the cathode electrode 79 and an external tangent of the rod lens 84*a,* and Y2 denotes a length between the other edge of the cathode electrode 79 and an external tangent of the rod lens 84*b.*

When Y1 and Y2 are detected by the CCD camera 90, the misalignment between the center line C of the rod lens arrays 65 and the cathode electrode 79 can be detected. Since the length from both edges of the cathode electrode 79 to the centers of the individual photo emitter arrays 61*a* and 61*b* are previously set and known, the misalignment between the center line C of the rod lens array and the centers of the photo emitter arrays 61*a* and 61*b* can be calculated. In this embodiment, the plurality of photo emitter arrays 61*a* and 61*b* are arranged in the second direction Y, and thus this can be applied to various uses, such as multiple-exposure. Moreover, the above method can be applied to a case where a single photo emitter array 61 is formed on the glass substrate 62.

Next, a fifth embodiment of the invention will be described with reference to FIG. 5. Similar components to those in the first embodiment will be designated by the same reference numerals, and repetitive explanations for those will be omitted.

In this embodiment, a width in the second direction Y of a cathode electrode 79 is formed wider than a diameter of the rod lens 84. Y3 denotes a length between one edge 79*a* of the cathode electrode 79 and an external tangent of the rod lens 84*b.* A length from one edge 79*a* of the cathode electrode 79 to the center of each of the photo emitter arrays 61*a* and 61*b* is previously set and known.

In this embodiment, the length of Y3, that is, the length between the external tangent of one rod lens 84*b* and the edge 79*a* of the cathode electrode 79 is detected, and thus the misalignment of the photo emitter arrays 61*a* and 61*b* can be detected. For this reason, the misalignment between the center line C of the rod lens arrays 65 and the center of each of the photo emitter arrays 61*a* and 61*b* can be detected. Since the one edge 79*a* of the cathode electrode 79 is used as a reference for the misalignment detection in the second direction Y, a processing for calculating the misalignment between the center line C of the rod lens arrays 65 and the center of each of the photo emitter arrays 61*a* and 61*b* can be simply performed.

Figure 14A:
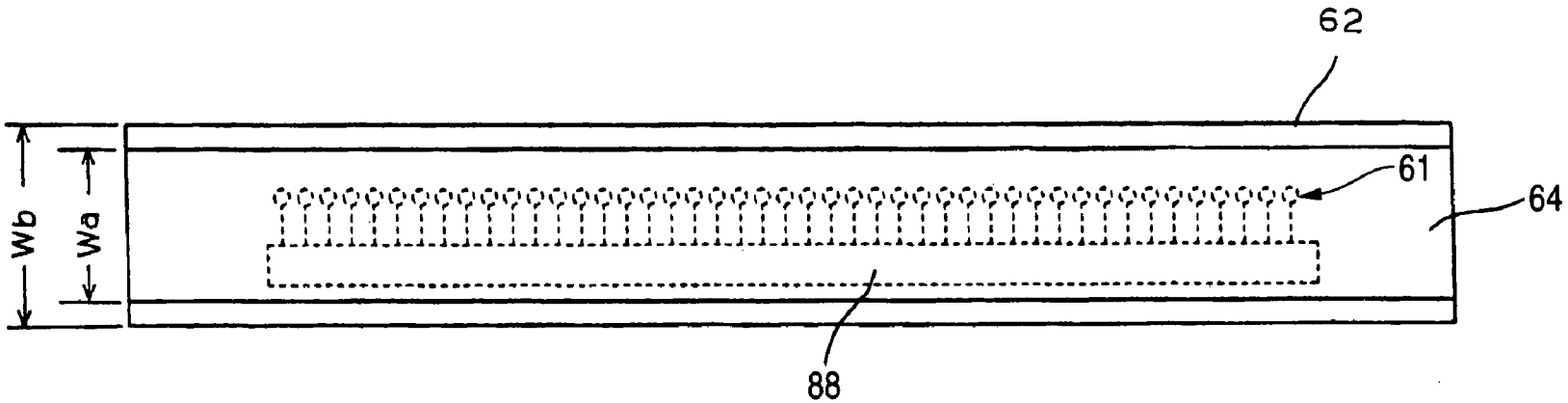
FIGS. 14A and 14B are a plan view and a side view for explaining a manufacturing method of an optical writing device according to a sixth embodiment of the invention.
Figure 14B:
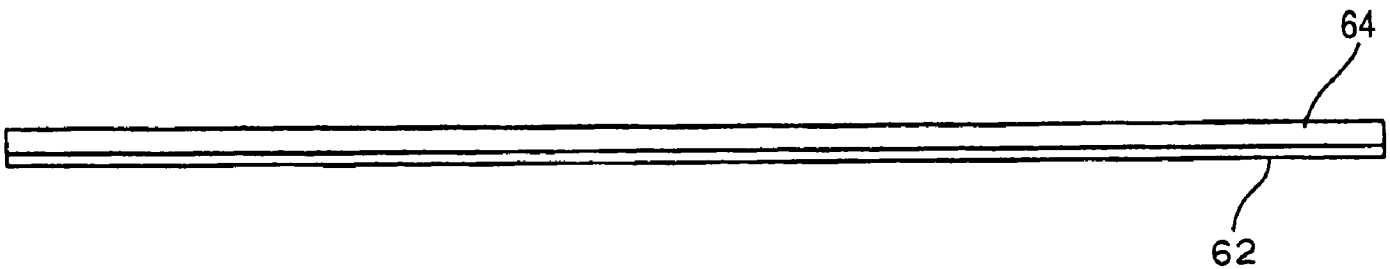

Next, a sixth embodiment of the invention will be described with reference to FIGS. 14A and 14B. Similar components to those in the first embodiment will be designated by the same reference numerals, and repetitive explanations for those will be omitted.

In this embodiment, the rod lens 84 is observed by the CCD camera 90 through the glass substrate 62. A width Wa of the cover plate 64 (sealing member) in the second direction Y is formed narrower than a width Wb of the glass substrate 62 in the second direction Y. For this reason, the light quantity of light, which passes through the transparent glass substrate 62, not being blocked by the cover plate 64, is increased, and thus the detection of the center line C of the rod lens arrays 65 can be facilitated.

At this time, since the edges on both sides of the cover plate 64 are also detected by the CCD camera 90, the misalignment between the position of the center line C of the rod lens arrays 65 and the photo emitter array 61 can be calculated. Therefore, by use of the adjusting screws 86*a,* 86*b* and the plate springs 85*a,* 85*b* described with reference to FIG. 12, the position of the glass substrate 62 in the second direction Y can be adjusted, and the alignment between the position of the center line C of the rod lens arrays 65 and the center position of the photo emitter array 61 can be performed.

Figure 15A:
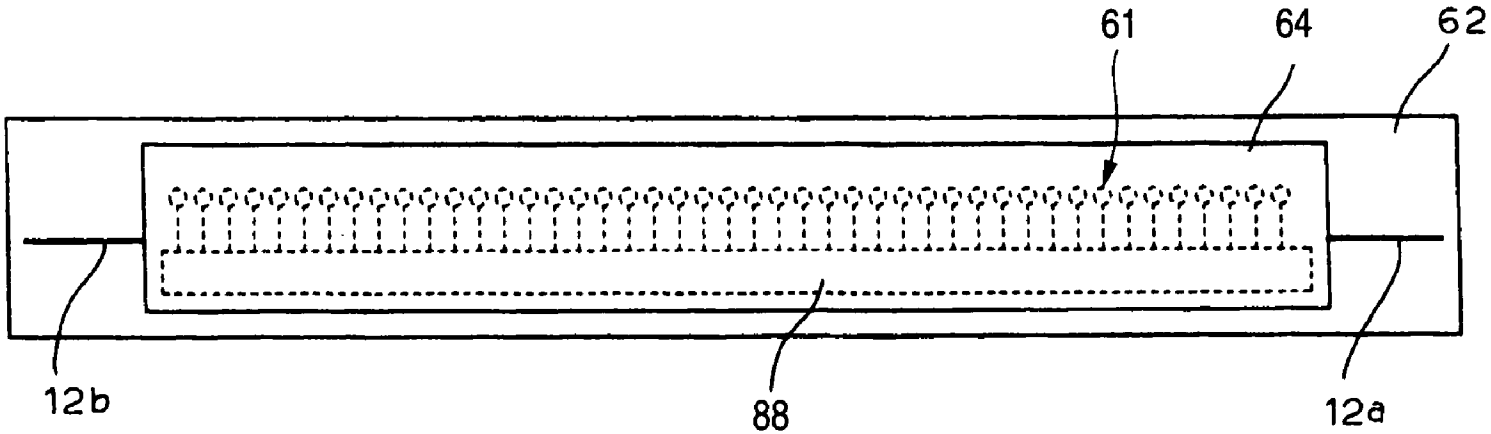
FIGS. 15A and 15B are a plan view and a side view for explaining a manufacturing method of an optical writing device according to a seventh embodiment of the invention.
Figure 15B:
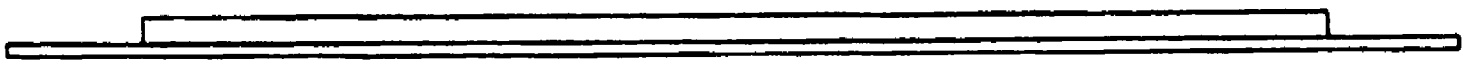

Next, a seventh embodiment of the invention will be described with reference to FIGS. 15A and 15B. Similar components to those in the first embodiment will be designated by the same reference numerals, and repetitive explanations for those will be omitted.

In this embodiment, a length of a cover plate 64 in the first direction X is made shorter than a length of the glass substrate 62. In this embodiment, the position of the center line C of the rod lens arrays 65 can be detected by the CCD camera 90 with light passing through both ends of the glass substrate 62. With the above configuration, alignment marks 12*a,* 12*b* can be provided on the glass substrate 62 at both sides of the cover plate 64 in the first direction X. With reference to the alignment marks 12*a,* 12*b,* the misalignment between the position of the center line C of the rod lens arrays 65 and the photo emitter array 61 can be easily corrected.

Further, since the cover plate 64 is also detected by the CCD camera 90, the misalignment between the position of the center line C of the rod lens arrays 65 and the photo emitter array 61 is calculated. Next, the alignment between the position of the center line C of the rod lens arrays 65 and the center position of the photo emitter array 61 can be performed by use of the mechanism of FIG. 12.

Figure 16B:
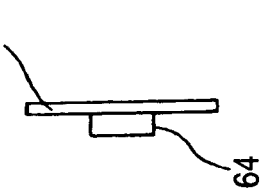
FIGS. 16A and 16B are a plan view and a side view for explaining a manufacturing method of an optical writing device according to an eighth embodiment of the invention.
Figure 16A:
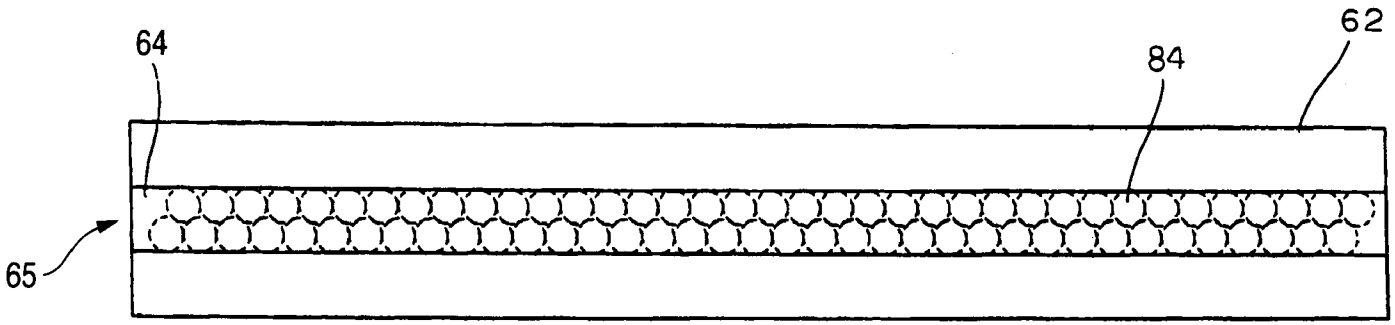

Next, an eighth embodiment of the invention will be described with reference to FIGS. 16A and 16B. Similar components to those in the first embodiment will be designated by the same reference numerals, and repetitive explanations for those will be omitted.

In this embodiment, a width of a cover plate 64 in the second direction Y is equal to a width of the rod lens arrays 65 in the second direction Y. When both edges of the cover plate 64 are detected by the CCD camera 90, the width of the rod lens arrays 65 is also detected. In this case, half of the width of the cover plate 64 becomes the center line C of the rod lens arrays 65, and thus a processing for calculating the misalignment between the position of the center line C of the rod lens arrays 65 and the photo emitter array 61 can be simplified.

Figure 17:
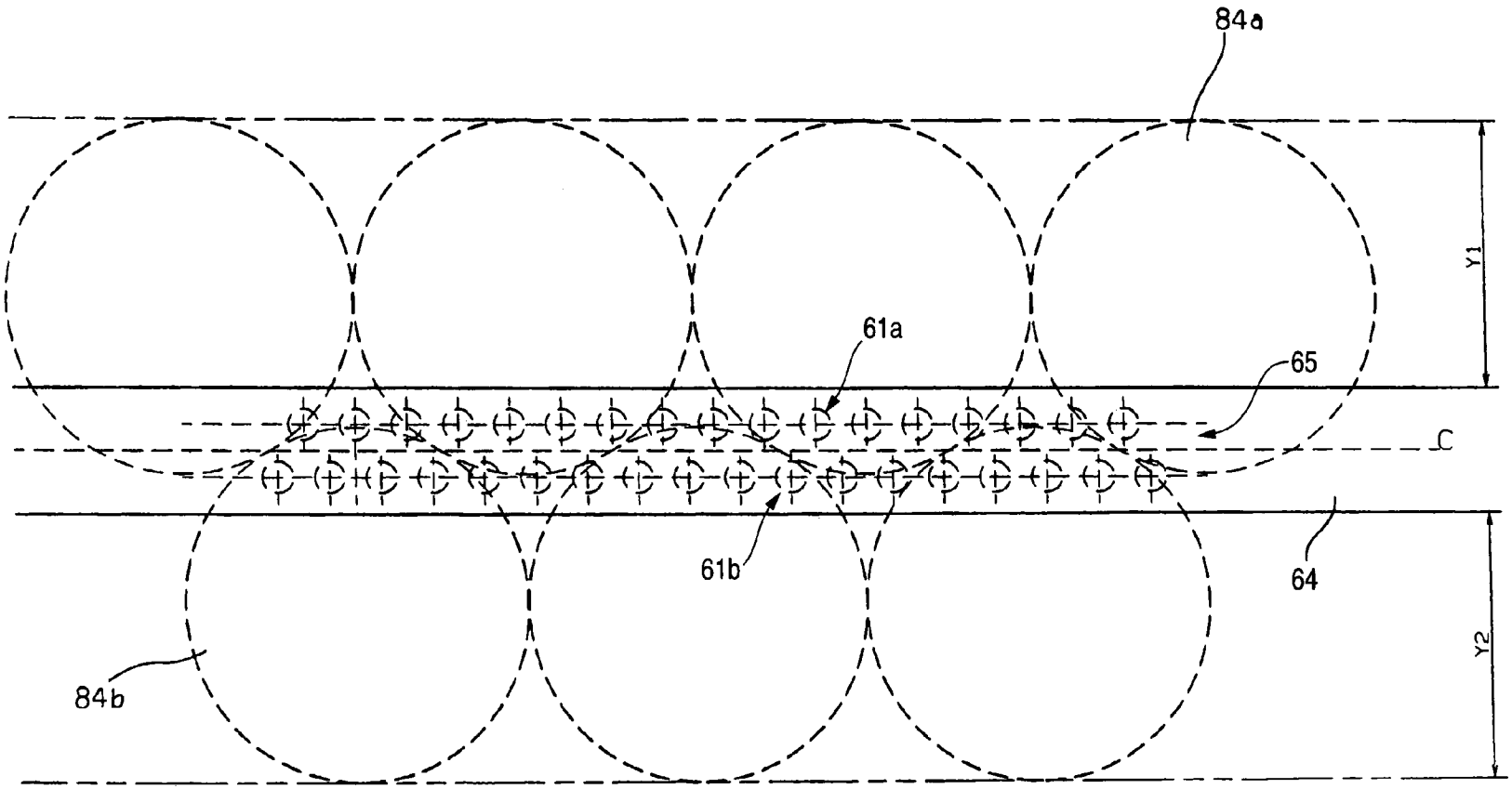
FIG. 17 is a schematic plan view for explaining a manufacturing method of an optical writing device according to a ninth embodiment of the invention.

Next, a ninth embodiment of the invention will be described with reference to FIG. 17. Similar components to those in the first embodiment will be designated by the same reference numerals, and repetitive explanations for those will be omitted.

In this embodiment, a width of a cover plate 64 in the second direction Y is made narrower than a width in the second direction Y of each of rod lenses 84*a* and 84*b.* The glass substrate 62 is not shown. Reference numerals 61*a* and 61*b* denote photo emitter arrays. Y1 denotes a length between one edge of the cover plate 64 and an external tangent of the rod lens 84*a,* and Y2 denotes a length between the other edge of the cover plate 64 and an external tangent of the rod lens 84*b.*

When Y1 and Y2 are detected by the CCD camera 90, the misalignment between the center line C of the rod lens arrays 65 and the cover plate 64 can be detected. Since the length from both edges of the cover plate 64 to the centers of the photo emitter arrays 61*a* and 61*b* are previously set 4 and known, the misalignment between the center line C of the rod lens arrays 65 and the centers of the photo emitter arrays 61*a* and 61*b* can be calculated. In this embodiment, the plurality of photo emitter arrays 61*a* and 61*b* are arranged in the second direction Y, and thus this can be applied to various uses, such as multiple-exposure. Moreover, the above method can be applied to a case where a single photo emitter array 61 is formed on the glass substrate 62.

Figure 18:
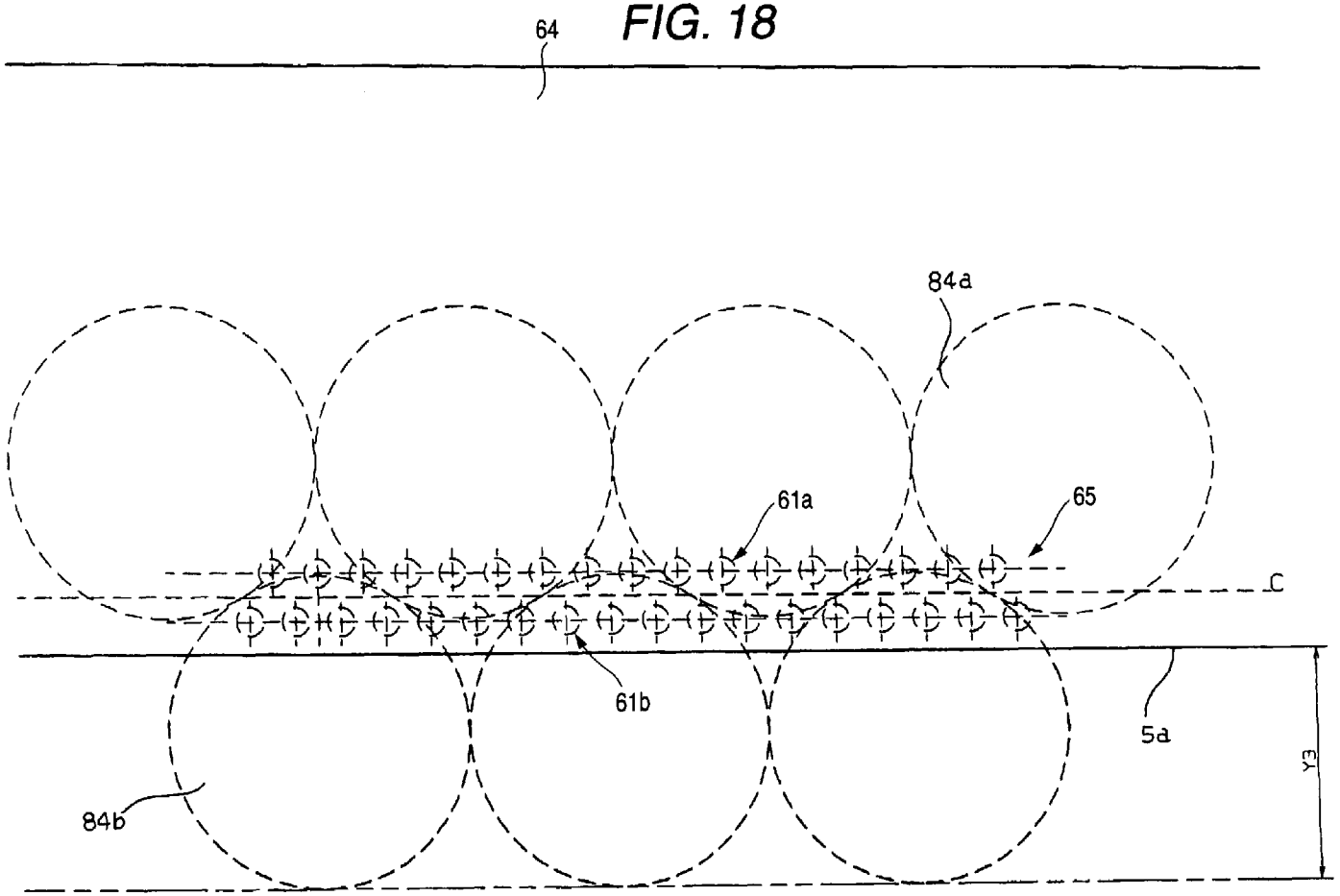
FIG. 18 is a schematic plan view for explaining a manufacturing method of an optical writing device according to a tenth embodiment of the invention.

Next, a tenth embodiment of the invention will be described with reference to FIG. 18. Similar components to those in the first embodiment will be designated by the same reference numerals, and repetitive explanations for those will be omitted.

In this embodiment, a width of a cover plate 64 in the second direction Y is formed wider than a diameter of the rod lens 84. Y3 denotes a length between one edge 79*a* of the cover plate 64 and an external tangent of the rod lens 84*b*. A length from one edge 79*a* of the cover plate 64 to the center of each of the photo emitter arrays 61*a* and 61*b* is previously set and known.

In this embodiment, the length of Y3, that is, the length between the external tangent of one rod lens 84*b* and the edge 79*a* of the cover plate 64 is detected, and thus the misalignment of the photo emitter arrays 61*a* and 61*b* can be detected. For this reason, the misalignment between the center line C of the rod lens arrays 65 and the center of each of the photo emitter arrays 61*a* and 61*b* can be detected. Since the one edge 64*a* of the cover plate 64 is used as a reference for the misalignment detection in the second direction Y, a processing for calculating the misalignment between the center line C of the rod lens arrays 65 and the center of each of the photo emitter arrays 61*a* and 61*b* can be simply performed.

Figure 19:
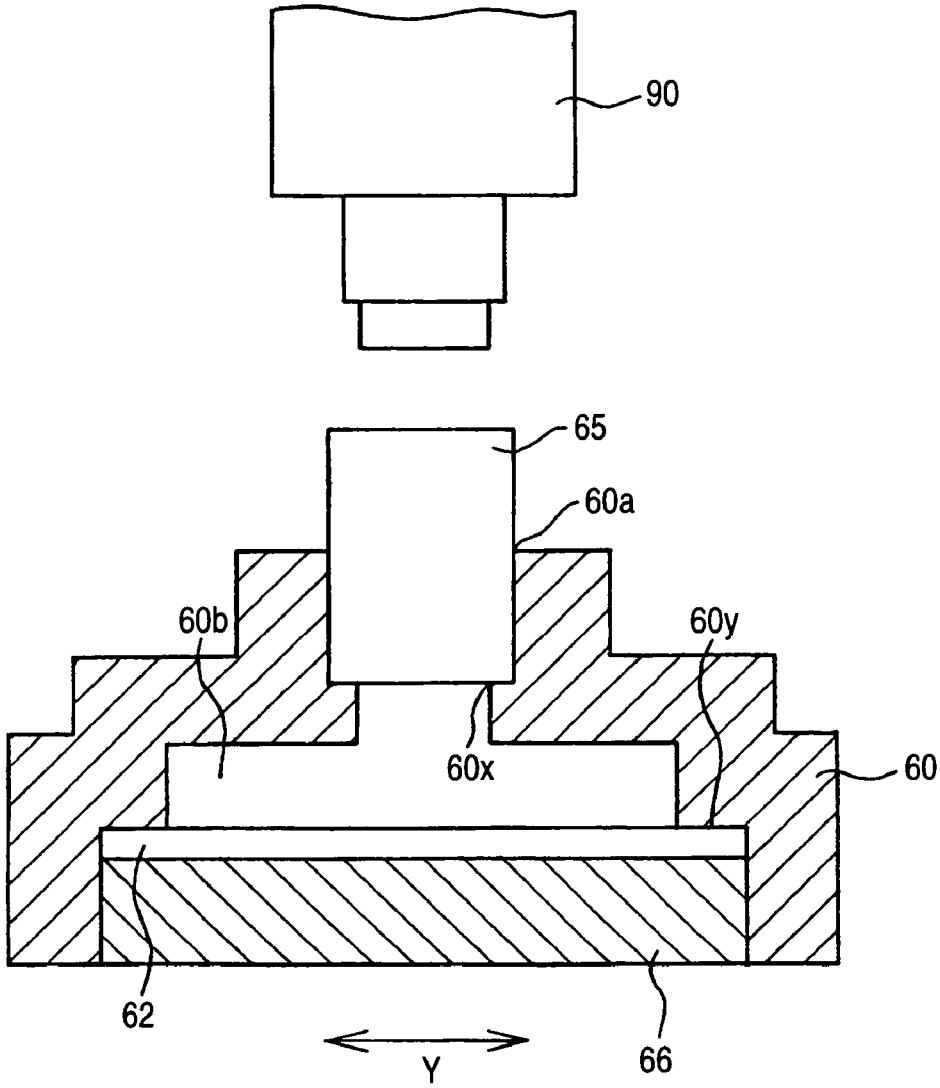
FIG. 19 is a section view relative to a direction perpendicular to an arrayed direction of photo emitters for explaining a manufacturing method of an optical writing device according to an eleventh embodiment of the invention.
Figure 20A:
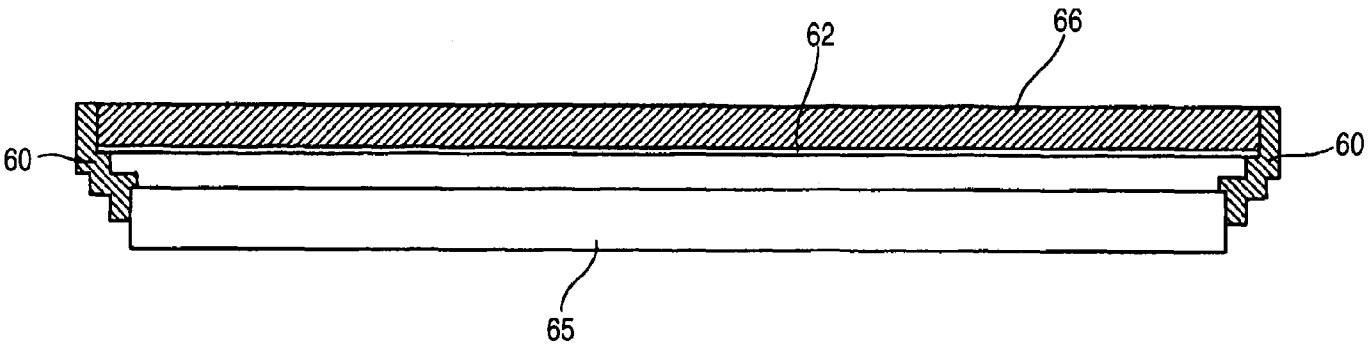
FIG. 20A is a section view of the optical writing device of FIG. 19 relative to the arrayed direction.
Figure 20B:
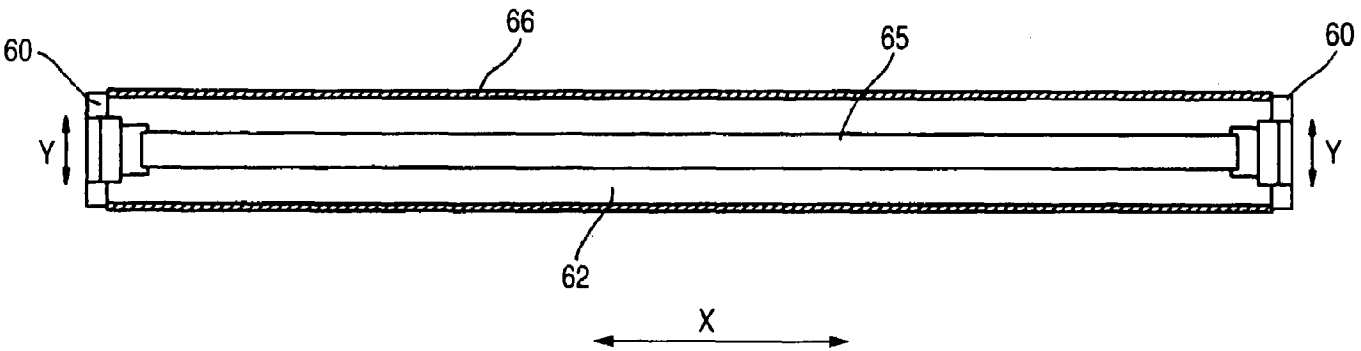
FIG. 20B is a plan view of the optical writing device of FIG. 19.

Next, an eleventh embodiment of the invention will be described with reference to FIGS. 19 to 20B. Similar components to those in the first embodiment will be designated by the same reference numerals, and repetitive explanations for those will be omitted.

In this embodiment, a reflectivity (first reflectivity) of the cathode electrode formed on the glass substrate 62 is made different from a reflectivity (second reflectivity) of the cover 66.

A sequence of the positioning will be described.

(1) The glass substrate 62 is supported on the cover 66 by an adhesive or the like. The cover 66 serves as a holder for the glass substrate 62.

(2) The rod lens array 65 is inserted into an opening 60*a* of the housing 60 and disposed on a step portion 60*x* to be fixed.

(3) The cover 66 is inserted into an opening 60*b* of the housing 60 and anchored on a step portion 60*y*. At this time, a slight gap exists between the cover 66 and the housing 60 in the second direction Y.

(4) The glass substrate 62 is observed through the rod lens array 65 by the CCD camera 90. An observation state of the glass substrate 62 from the CCD camera 90 is as shown in FIG. 20B.

(5) As described above, the reflectivity of the cathode electrode (common electrode) 79 formed on the glass substrate 62 is made different from the reflectivity of the cover 66. For this reason, an intensity of reflected light from the cover 66 passing through the glass substrate 62 is different from an intensity of reflected light from the cathode electrode 79. Therefore, the position of the cathode electrode 79 and the position of the rod lens array 65 can be easily recognized by the CCD camera 90.

(6) The positional relationship between the width of the cathode electrode 79 in the second direction Y and the center of the photo emitter array 61 is stored in the memory 103 (see FIG. 13) in advance. Therefore, if the width of the cathode electrode 79 in the second direction Y is imaged by the CCD camera 90 (image capturer 102), the misalignment of the center line C of the rod lens arrays 65 with respect to the center of the photo emitter array 61 can be calculated.

(7) The housing 60 is moved in the second direction Y so as to adjust the misalignment, and the center line C of the rod lens arrays 65 is aligned with respect to the center of the photo emitter array 61.

(8) The cover 66 is fixed to the housing 60 by an adhesive or the like.

(9) The housing 60 is mounted on a casing of an optical writing device (line head). As such, the center line C of the rod lens arrays 65 is aligned on the basis of the center of the photo emitter 63. For this reason, the misalignment between the rod lens array 65 and the center of the photo emitter 63 can be prevented from occurring due to a mounting error of the rod lens array 65, and imaging performance can be suppressed from being lowered.

As described the above, the image capturer 102 observes the rod lens array 65 and the cathode electrode 79 formed on the glass substrate 62. The memory 103 stores the positional relationship between the positions of the cathode electrode 79 and the photo emitters 63.

The control circuit 104 reads out data on the positional relationship between the cathode electrode 79 and the center of the photo emitters 63 from the memory 103, and compares that data with data of the cathode electrode 79 detected by the image capturer 102 so as to calculate the misalignment between the center of the photo emitters 63 and the center line C of the rod lens arrays 65. Further, the control circuit 104 transmits a signal to the driver circuit 88 so as to control the position of the supporting member.

Figure 21:
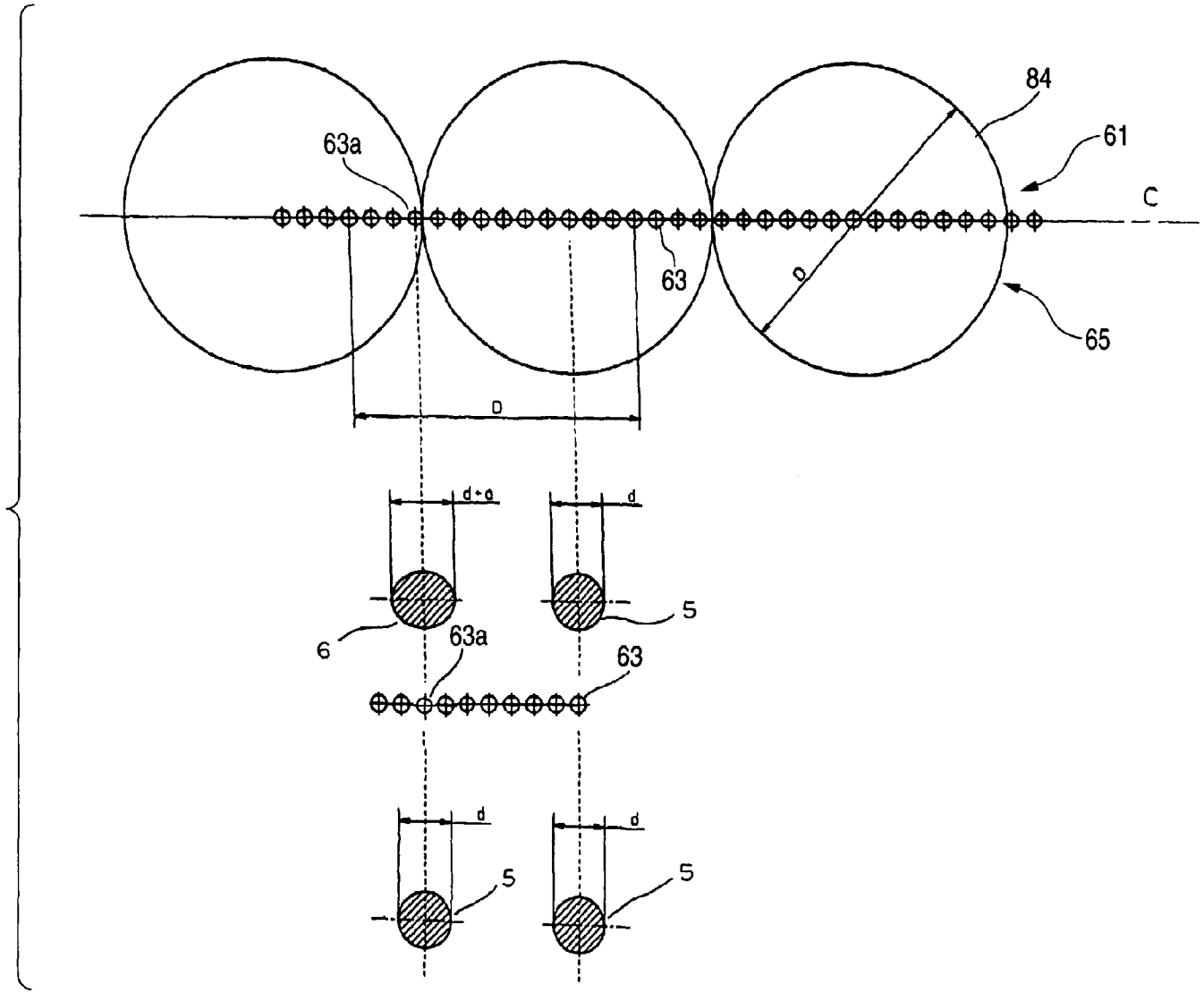
FIG. 21 is a diagram for explaining a manufacturing method of an optical writing device according to a twelfth embodiment of the invention.

Next, a twelfth embodiment of the invention will be described with reference to FIG. 21. Similar components to those in the first embodiment will be designated by the same reference numerals, and repetitive explanations for those will be omitted.

Figure 33:
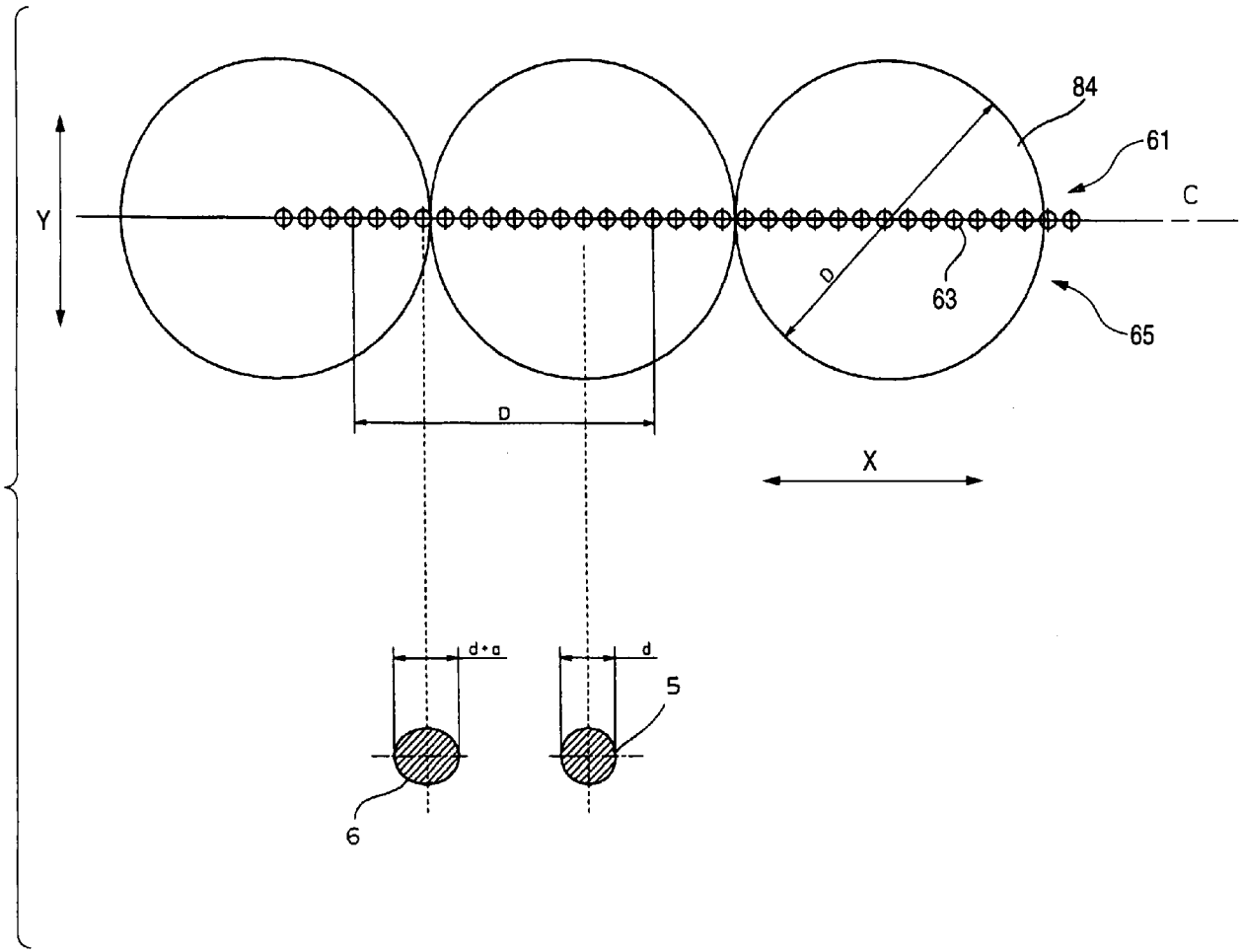
FIGS. 33 and 34 are diagrams for explaining shape variation of a light spot formed by an optical writing device which is caused by a positional relationship between a photo emitter and a rod lens relative to the arrayed direction of photo emitters.
Figure 34:
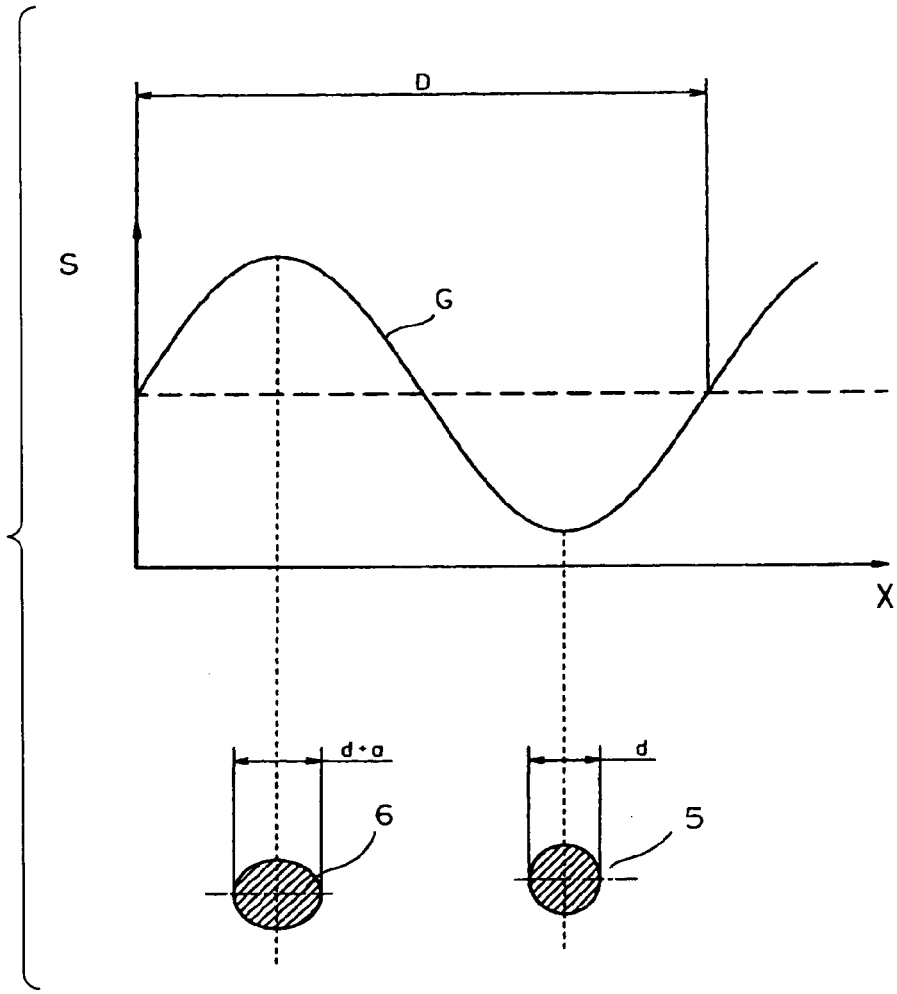
Figure 35:
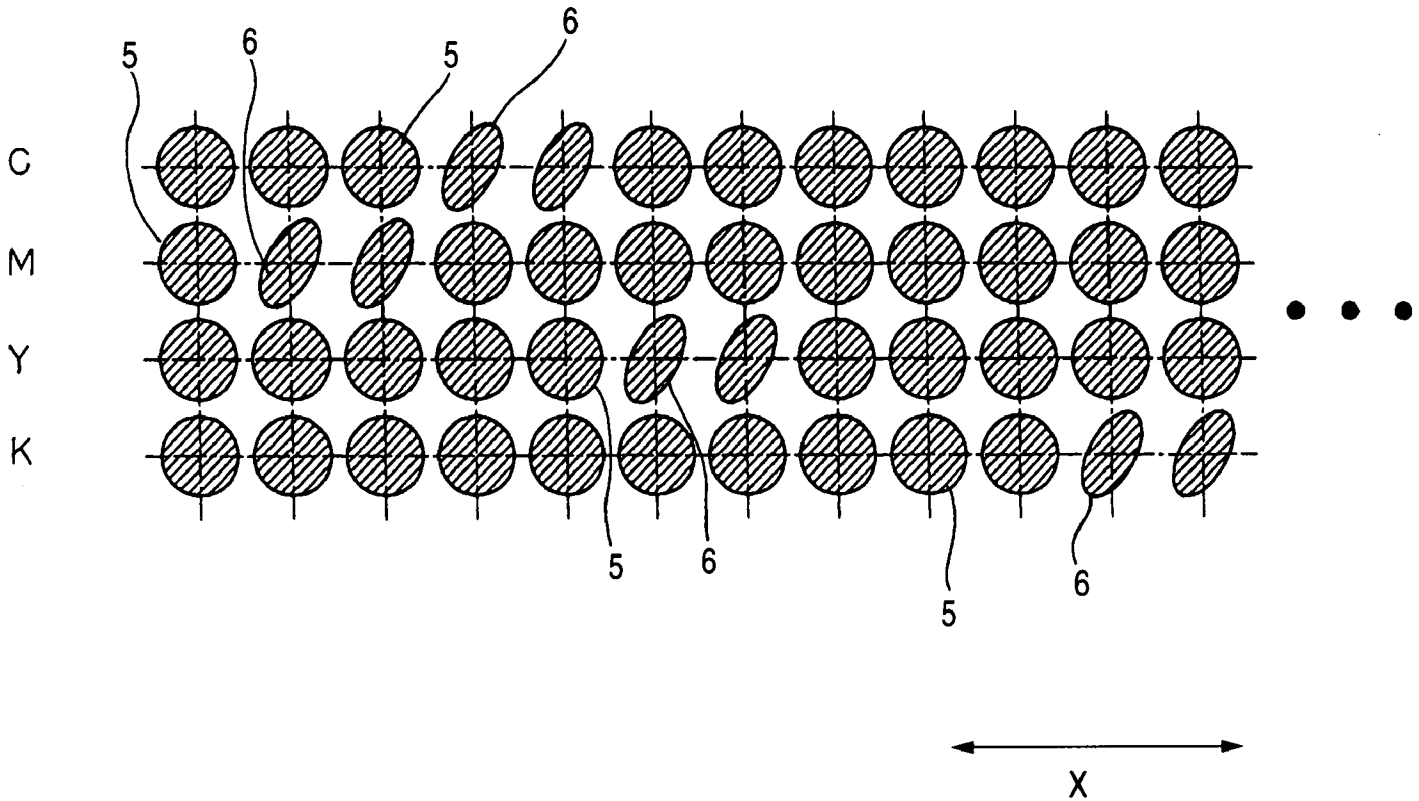
FIG. 35 is a diagram for explaining the shape variation of light spots formed by an optical writing device for forming a full color image.

In this embodiment, a single photo emitter array 61 and a single rod lens array 65 are. As is described with reference to FIG. 33, the spread shapes of light beams, such as the light spots 5 and 6, are normally different from each other due to the relative positional relationship between the photo emitter 63 and the rod lens 64 in the first direction X, and a difference in imaging area occurs.

In this embodiment, the shape of the photo emitter is changed. That is, the photo emitters arranged at positions close to positions of adjacent rod lenses in the first direction X by a pitch of a diameter of the lens has a reduced size, as indicated by reference numeral 63*a*, such that the spread shape of the lens is corrected. As a result, the shape of the light spot formed by the light emitter 63*a* is the same as the shape of the light spot 5 formed by the photo emitter 63.

Specifically, when light emitted from the photo emitter 63*a* passes through the lens array at a position where the lenses are adjacent to each other in the first direction X, the imaging area of the surface to be irradiated is reduced, and is formed to have the same size as the imaging area by the photo emitter 63 having the normal size. Therefore, image quality can be prevented from being degraded due to fluctuation in imaging area.

Figure 22:
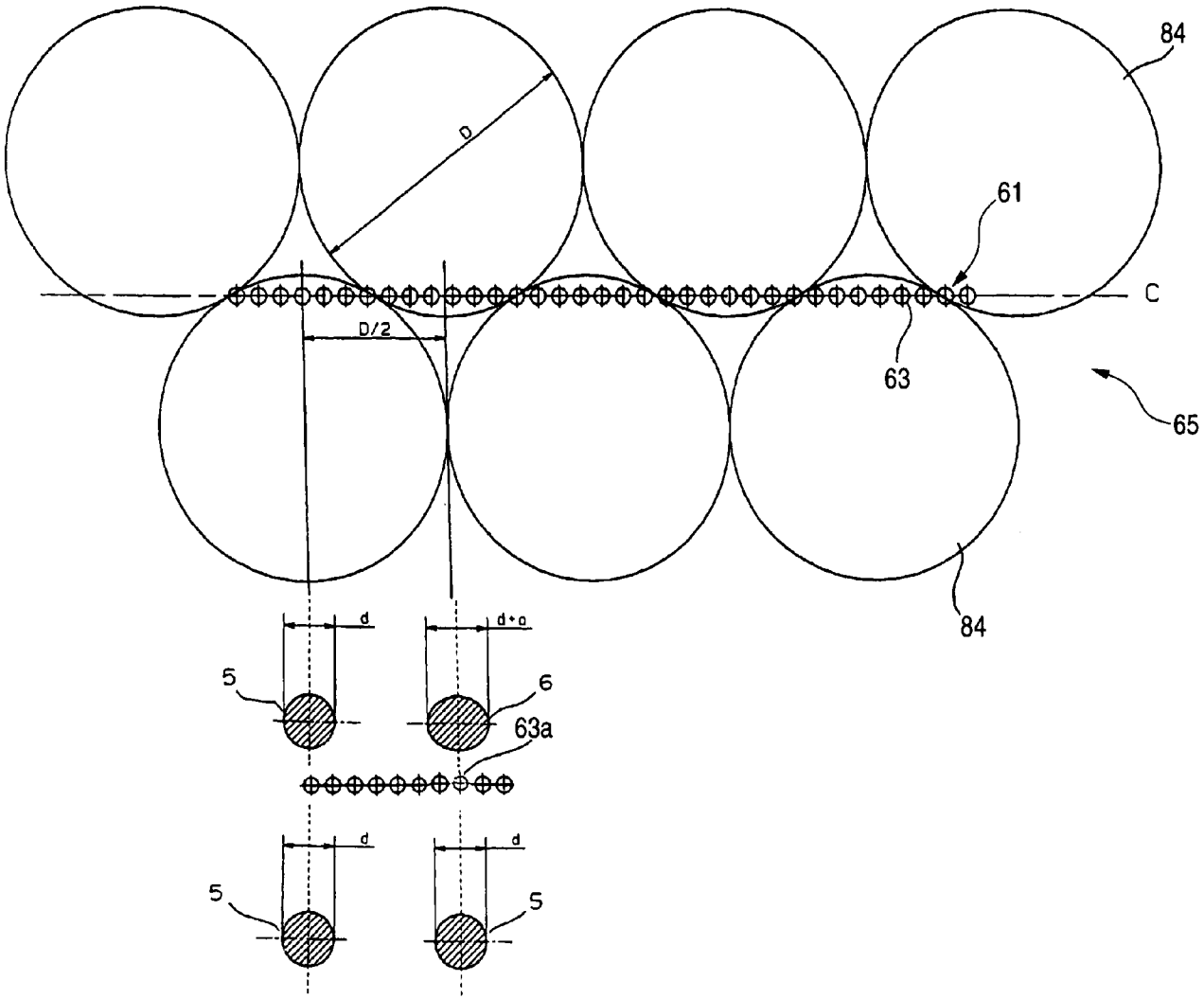
FIG. 22 is a diagram for explaining a manufacturing method of an optical writing device according to a thirteenth embodiment of the invention.

Next, a thirteenth embodiment of the invention will be described with reference to FIG. 22. Similar components to those in the first embodiment will be designated by the same reference numerals, and repetitive explanations for those will be omitted.

In this embodiment, a single photo emitter array 61 and two rod lens arrays 65 are arranged in the second direction Y. In this configuration, the shape of the light spot 6 is normally different from the shape of the light spot 5 by a pitch of a radius (½)D of the rod lens 84.

In this embodiment, the shape of the photo emitter 63*a* arranged at a position close to the positions of adjacent rod lenses in the first direction X by a half pitch of the diameter D of the rod lens 84 is made smaller than the shape of the photo emitter 63, such that the spread shape of the light beam at an imaging position is corrected. For this reason, the shape of the light spot formed by the photo emitter 63*a* is the same as the shape of the light spot 5 formed by the photo emitter 63.

Figure 23:
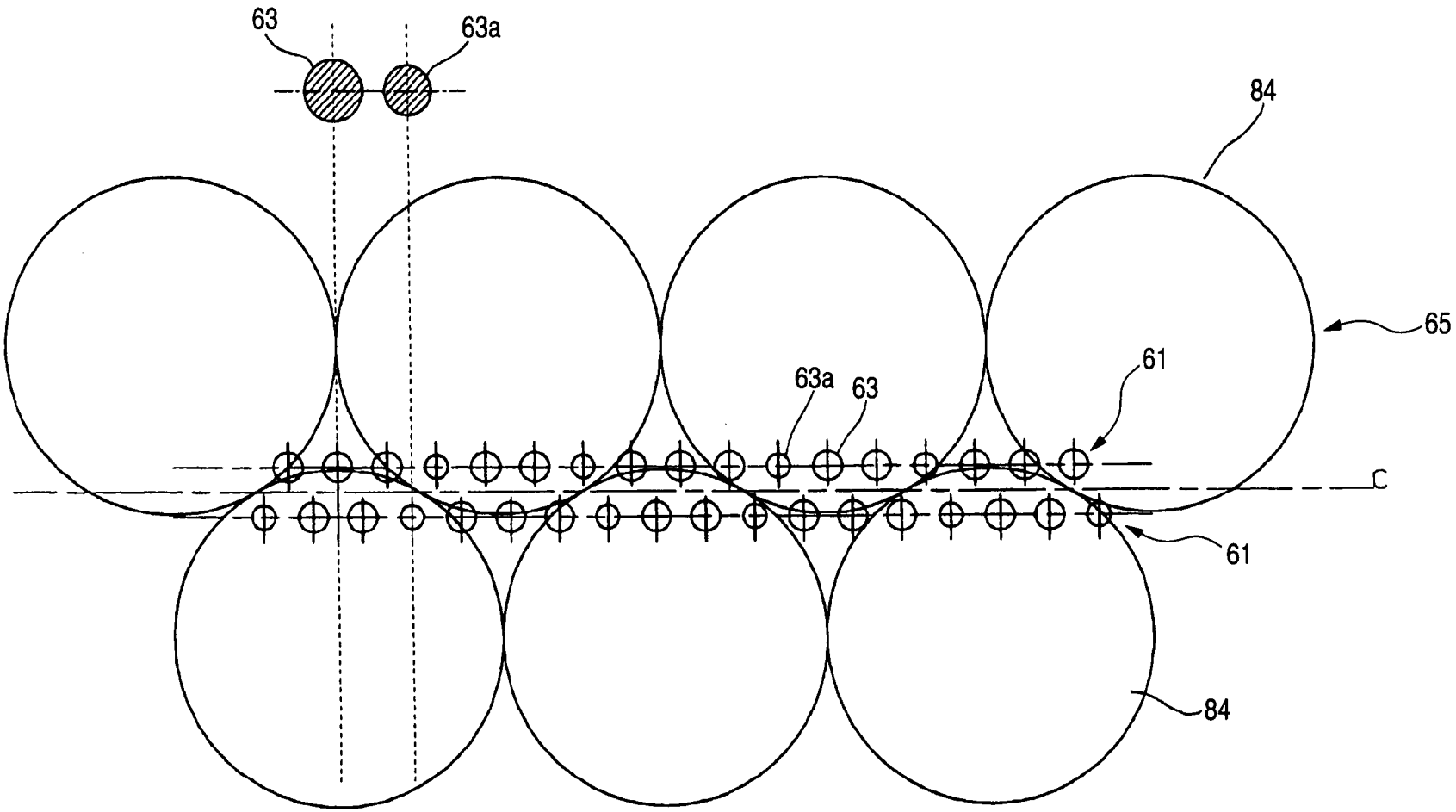
FIG. 23 is a diagram for explaining a manufacturing method of an optical writing device according to a fourteenth embodiment of the invention.

Next, a fourteenth embodiment of the invention will be described with reference to FIG. 23. Similar components to those in the first embodiment will be designated by the same reference numerals, and repetitive explanations for those will be omitted.

In this embodiment, two photo emitter arrays 61 and two rod lens arrays 65 are arranged in the second direction Y. As well as the twelfth embodiment, the shape of the photo emitter 63*a* is made smaller than the shape of the photo emitter 63 by the pitch of the radius (½)D of the rod lens 84. Therefore, the spread shape of the imaging area by the photo emitter 63*a* at a position close to adjacent rod lens 84 in the first direction X can be corrected.

As an example of modification, there may be configured that two photo emitter arrays 61 and a single rod lens array 65 is arranged in the second direction Y. In this case, the shape of the photo emitter 63*a* is made different from the shape of the photo emitter 63 by the pitch of the diameter D of the rod lens 84.

Figure 24:
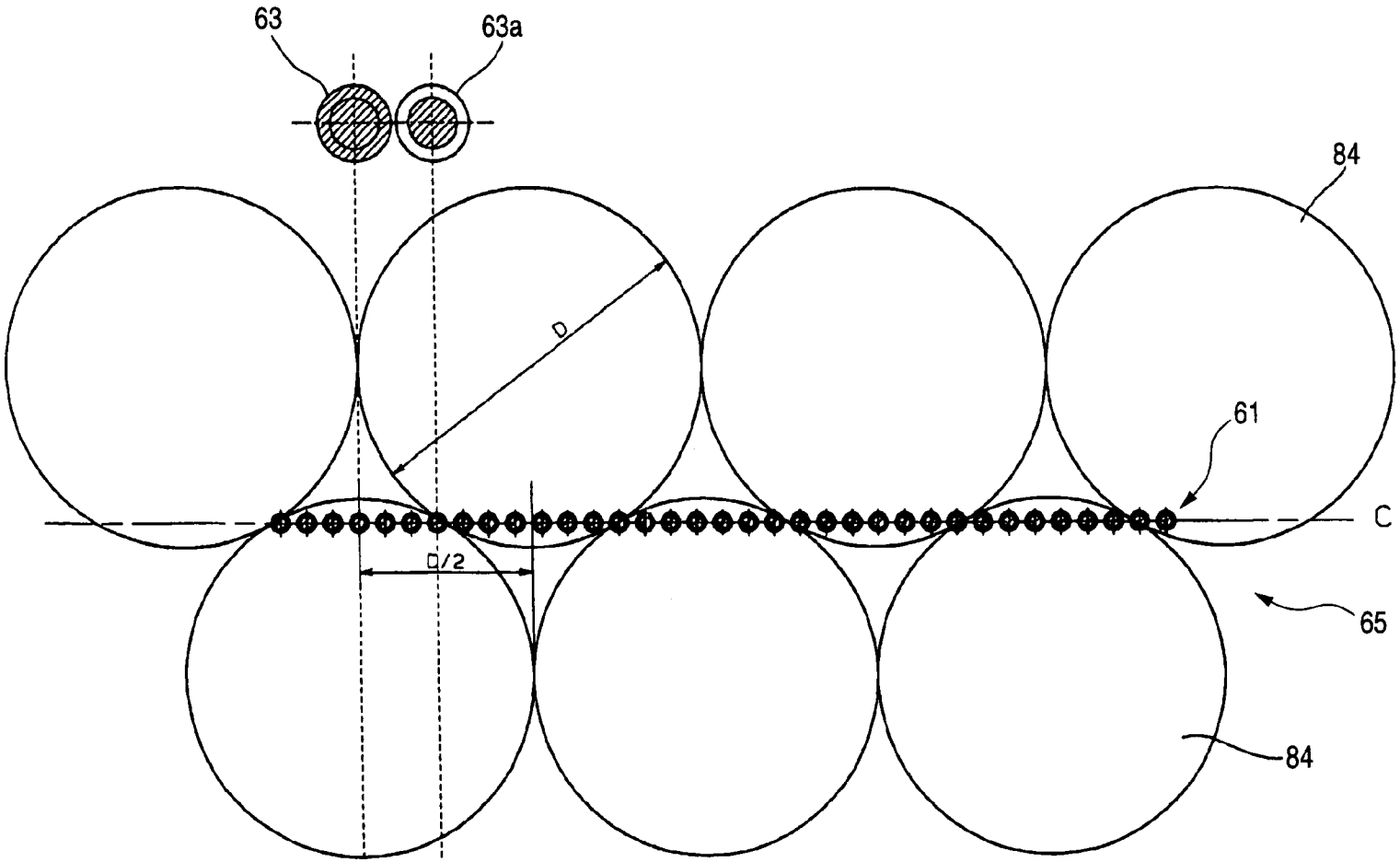
FIG. 24 is a diagram for explaining a manufacturing method of an optical writing device according to a fifteenth embodiment of the invention.

Next, a fifteenth embodiment of the invention will be described with reference to FIG. 24. Similar components to those in the first embodiment will be designated by the same reference numerals, and repetitive explanations for those will be omitted.

In this embodiment, a single photo emitter array 61 and two rod lens arrays 65 are arranged in the second direction Y. The photo emitter in this embodiment is capable of change a light emission area. Reference numeral 63 denotes a case where both of an inner light emission area and an outer light emission area are used. Reference numeral 63*a* denotes a case where only the inner light emission area is used.

Specifically, the light emission area is made smaller by the pitch of the radius (½)D of the rod lens 84. In this case, the spread shape of the imaging area by the photo emitter at the position close to adjacent rod lenses in the first direction X can be also corrected.

There may be configured that two photo emitter arrays 61 are arranged in the second direction Y. Further, there may be configured that a single photo emitter array 61 and a single rod lens array 65 are arranged in the second direction Y.

In addition, there may be configured that two photo emitter arrays 61 and a single rod lens array 65 are arranged in the second direction Y. In the configuration in which a single rod lens array 65 is arranged, the light emission area of the photo emitter is made smaller by the pitch of the diameter D of the rod lens 84. Further, three or more photo emitter arrays may be arranged in the second direction Y.

As such, the combination of the number of photo emitter arrays 61 and the number of rod lens arrays 65 can be arbitrarily selected. Further, in case of a configuration in which three or more photo emitter arrays arranged in the second direction Y, the optical writing device can be applied to various uses, such as multiple-exposure and the like. When three or more photo emitter arrays in the second direction Y, one or two rod lens arrays can be suitably selected.

Next, a sixteenth embodiment of the invention will be described with reference to FIGS. 25 to 30. Similar components to those in the first embodiment will be designated by the same reference numerals, and repetitive explanations for those will be omitted.

Figure 25:
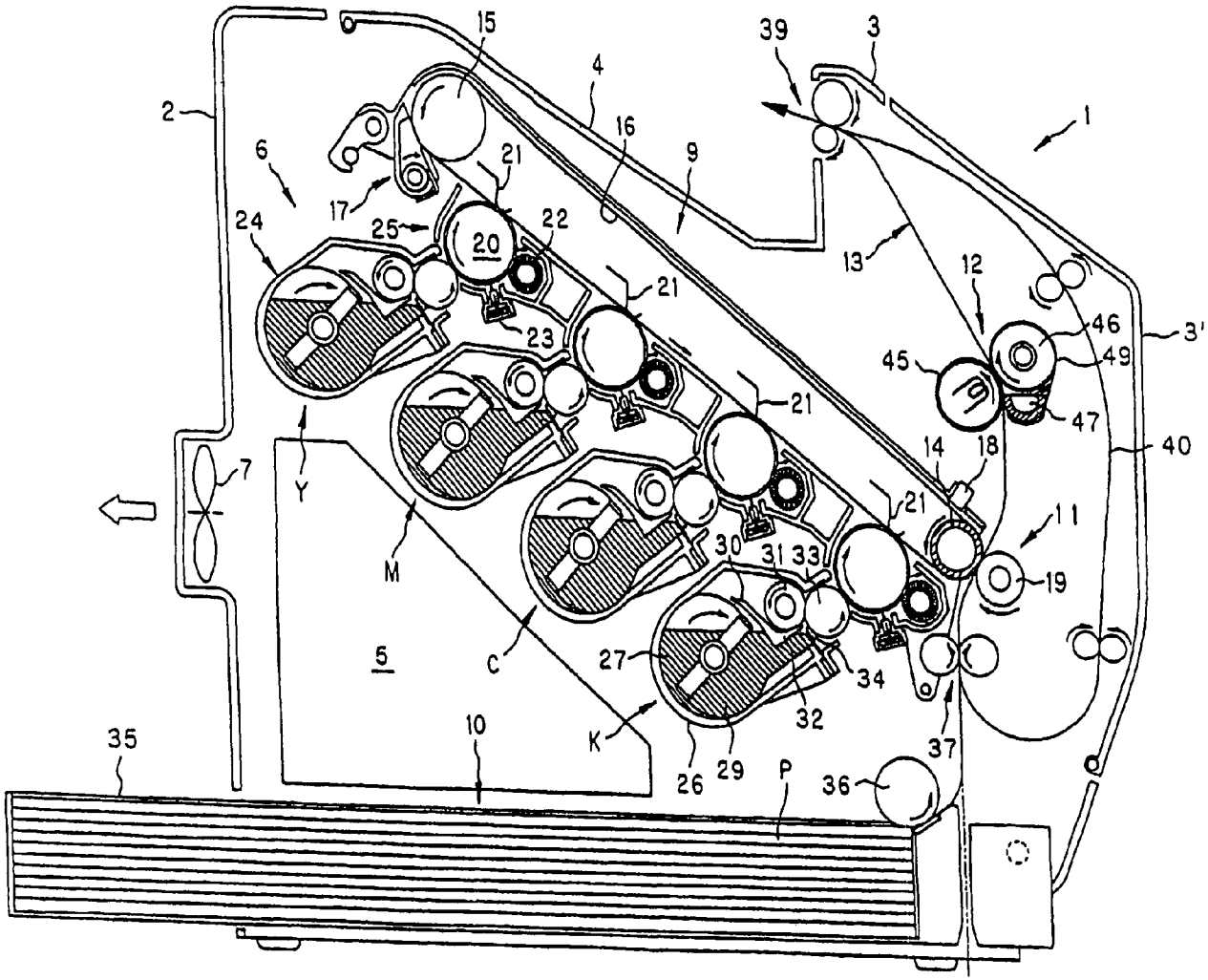
FIG. 25 is a section view of a color image forming apparatus.

FIG. 25 shows a color image forming apparatus 1 in which a line head (optical writing device) 23 whose position is adjusted in the first direction X is incorporated. The image forming apparatus I has a housing body 2, a first door cover 3 that is installed in front of the housing body 2, and a second door cover 4 that is installed at the top of the housing body 2 (which also serves as an ejection tray) in addition, the first door cover 3 has a door member 3' that is installed in front of the housing body 2.

In the housing body 2, an electrical component box 95 that houses a power supply circuit board and a control circuit board therein, an image forming unit 96, a blower fan 7, a transfer belt unit 9, a sheet feeding unit 10 are provided. Further, right behind the first door cover 3, a secondary transfer unit 11, a fuser unit 12, and a sheet transporting unit 13 are provided.

The transfer belt unit 9 has a driving roller 14 rotated by a driving source (not shown), a follower roller 15 that is obliquely provided above the driving roller 14, an intermediate transfer belt 16 that is tensioned between the two rollers 14 and 15 and is circulated in an arrow direction in FIG. 25, and a cleaning unit 17 that is retractably brought into contact with a surface of the intermediate transfer belt 16.

A primary transfer member 21 having a plate spring electrode faces an image carrier 20 of each of image forming stations Y, M, C, and K to be brought into contact by its elastic force, and a transfer bias is applied to the primary transfer member 21 in the transfer belt unit 9, a test pattern sensor 18 is provided in the vicinity of the driving roller 14. The image forming unit 96 has the image forming stations Y (for yellow), M (for magenta), C (for cyan), and K (for black) which form an image of plural different colors (in the present example, four colors). Each of the image forming stations Y, M, C, and K has the image carrier 20 having a photosensitive drum, and a charging unit 22, an image writing unit (line head) 23, and a developing unit 24, which are provided in the vicinity of the image carrier 20.

Figure 5:
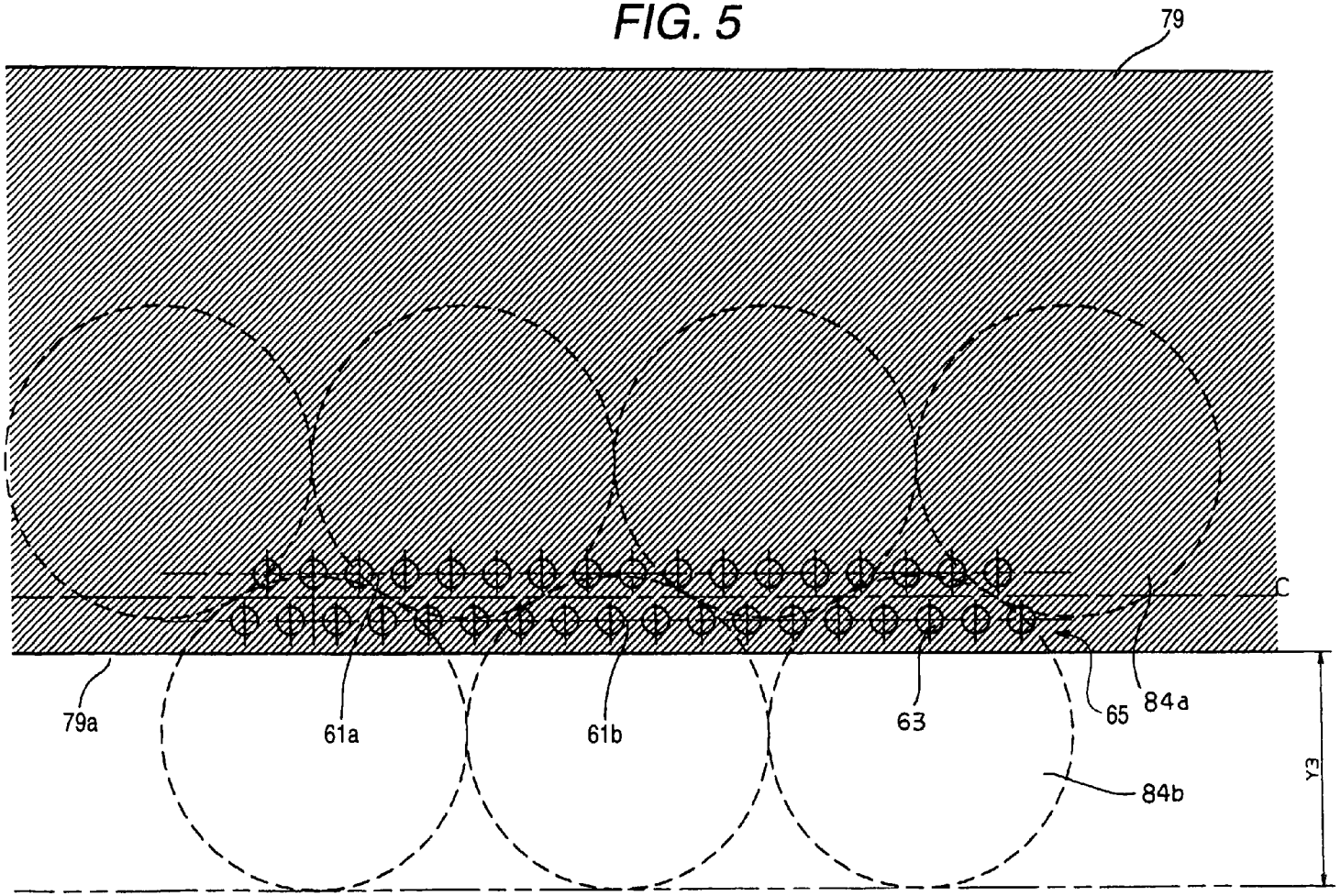
FIG. 5 is a schematic plan view for explaining a manufacturing method of an optical writing device according to a fifth embodiment of the invention.

As indicated by an arrow in FIG. 5, the image carrier 20 is rotated in a transport direction of the intermediate transfer belt 16. The charging unit 22 has a conductive brush roller connected to a high-voltage generating source. The circumference of a brush of the charging unit 22 is rotated at a peripheral velocity of two or three times in an opposite direction to the image carrier 20 serving as a photosensitive in a state of being brought into contact with the image carrier 20, and uniformly charges a surface of the image carrier 20.

The line head 23 uses a photo emitter array in which organic EL elements are arranged in a linear shape in an axis direction of the image carrier 20 (i.e., the first direction X). The line head using the photo emitter array is compact since the length of its optical path is shorter than that of a laser scanning optical system. Therefore, the line head can be disposed close to the image carrier 20, and the entire device can be reduced in size. In the present embodiment, the image carrier 20, the charging unit 22, and the line head 23 of each of the image forming stations Y, M, C, and K is integrated as an image carrier unit 25.

Next, the details of the developing unit 24 will be described on the basis of the image forming station K. The developing unit 24 has a toner container 26 that stores a toner (a hatched portion of FIG. 25), a toner storage unit 27 that is formed in the toner container 26, a toner stirring member 29 that is provided in the toner storage unit 27, and a partition member 30 that is divided and formed at the top of the toner storage unit 27.

Further, in the developing unit 24, a toner supply roller 31 that is provided above the partition member 30, a blade 32 that is brought into contact with the toner supply roller 31 provided in the partition member 30, a developing roller 33 that is provided to be brought into contact with the toner supply roller 31 and the image carrier 20, and a regulating blade 34 that is brought into contact with the developing roller 33 are provided.

The sheet feeding unit 10 includes a sheet feeding cassette 35 in which recording media P (e.g., sheets of paper) are stacked and held, and a pickup roller 36 that feeds the recording medium P from the sheet feeding cassette 35 one by one. A pair of register rollers 37 that defines the timing for feeding the recording medium P to the secondary transfer unit 11 which is adapted to be brought into press contact with the driving roller 14 and the intermediate transfer belt 16, the fuser unit 12, the sheet transporting unit 13, a pair of ejecting rollers 39, and a transporting path 40 for double-sided printing are provided.

The fuser unit 12 has a heating roller 45 that is rotatably provided with a built-in heating body, such as a halogen heater, a pressing roller 46 that is brought into press contact with the heating roller 45, a suspender 47 that is pivotably provided in the pressing roller 46, and a heat-resistant belt 49 that is tensioned between the pressing roller 46 and the suspender 47. A color image, which is secondarily transferred on the recording medium, is fused on the recording medium P at a predetermined temperature at a nip portion formed by the heating roller 45 and the heat-resistant belt 49.

In this embodiment, a position in the first direction X of a light spot having a larger size is detected for each color. And then, on the basis of any one color, for example, cyan (C), the positions in the first direction X of the light spots having the larger size for other colors are aligned, and thus color fluctuation is prevented from occurring.

Figure 27:
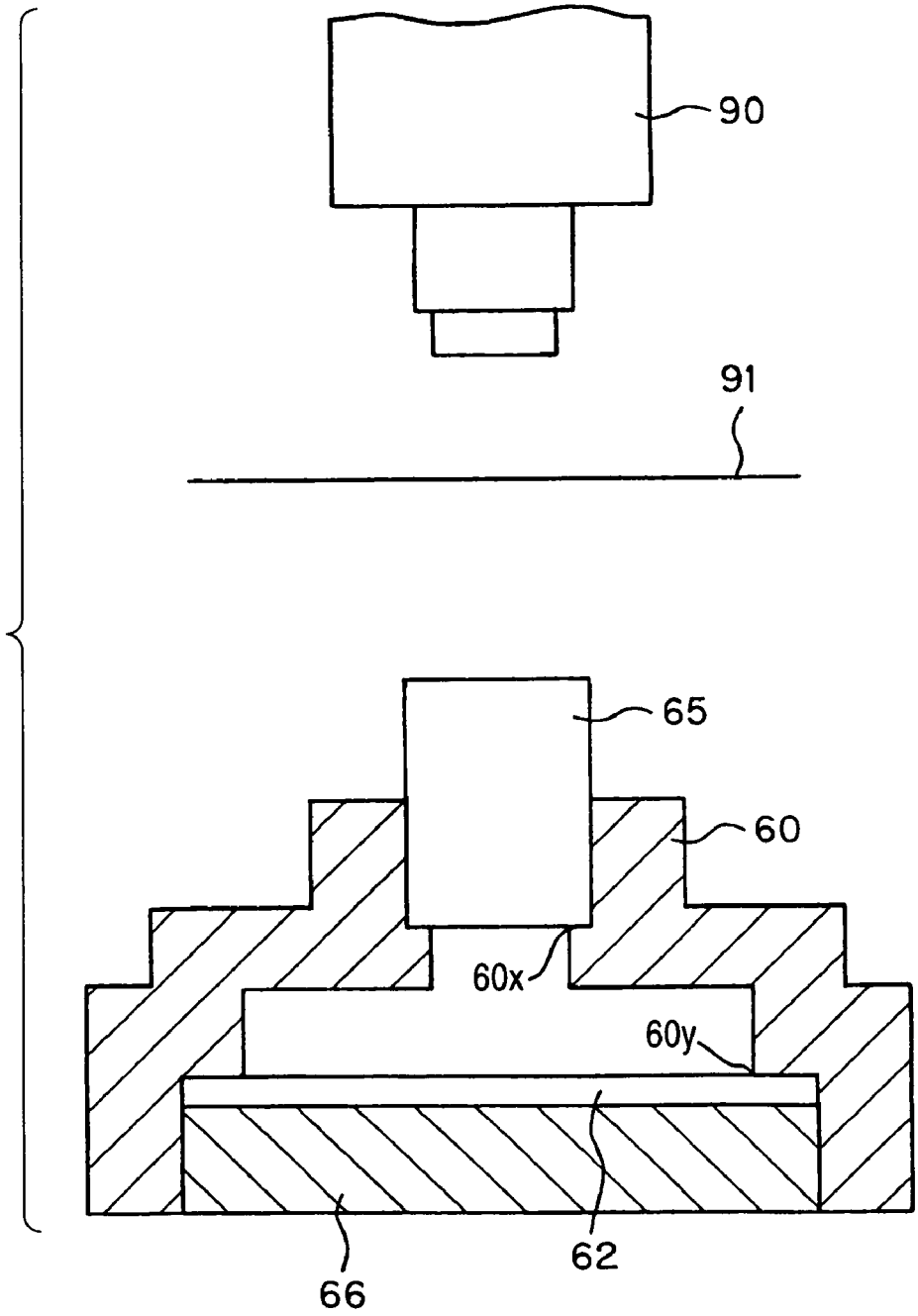
FIG. 27 is a section view relative to a direction perpendicular to an arrayed direction of photo emitters for explaining the manufacturing method of the sixteenth embodiment.

How to detect the position in the first direction X of the light spot having the larger size is detected for each color, and how to align the positions in the first direction of the light spots having the larger sizes for the respective colors will be described with reference to FIG. 27.

(1) The cover 66 is adhered to the glass substrate 62.

(2) The rod lens array 65 is inserted into the housing 60, and is disposed on a step portion 60*x* to be fixed.

(3) The glass substrate 62 with the cover 66 adhered thereto is inserted into the housing 60, and is disposed on a step portion 60*y* to be fixed.

(4) The housing 60 is mounted on the casing of the line head (not shown). At this time, the fixing screws are loosened such that the housing 60 can be slightly moved in the first direction X.

(5) The photo emitters are caused to emit light so as to form the light spots for one line on the surface to be irradiated 91 in the first direction X.

(6) The surface to be irradiated 91 is observed by the CCD camera 90. The captured image at this time becomes an image of the light spot shapes for one line in the first direction X. The captured image is transmitted and is stored in the memory 103 (see FIG. 13).

(7) The steps (1) to (6) are sequentially performed for each color.

(8) On the basis of data acquired by the CCD camera 90, the imaging position of each light spot of a reference color, for example, cyan (C), formed in the first direction X is set. For other colors, the imaging position of each light spot formed in the first direction X is set. On the basis of set data for the reference color and other colors, the shapes of the light spots in the first direction X are compared with one another. The misalignment in the first direction X among the light spots having the larger size for the respective colors is calculated.

(9) On the basis of calculated misalignment information of each color in the first direction X with respect to the reference color (in this case, cyan), the housing 60 is moved in the first direction X so as to align the positions of the light beams having the larger size of other colors on the surface to be irradiated 91. At this time, the alignment is performed by moving the housing 60 while being observed by the CCD camera 90.

(10) The positioned housing 60 is fixed to the casing of the line head 23 by the screws.

As is described the above, the image capturer 102 (CCD camera 90) observes the light spot shape formed on the surface to be irradiated 91. The memory 103 stores the captured image data for each color.

The control circuit 104 reads out image data for each color from the memory 103, and calculates the misalignment in the first direction X among the light spots having the larger size for the respective colors. Further, the control circuit 104 transmits a signal to the driver circuit 88 and controls a voltage or a driving current of the photo emitters 63.

Figure 26:
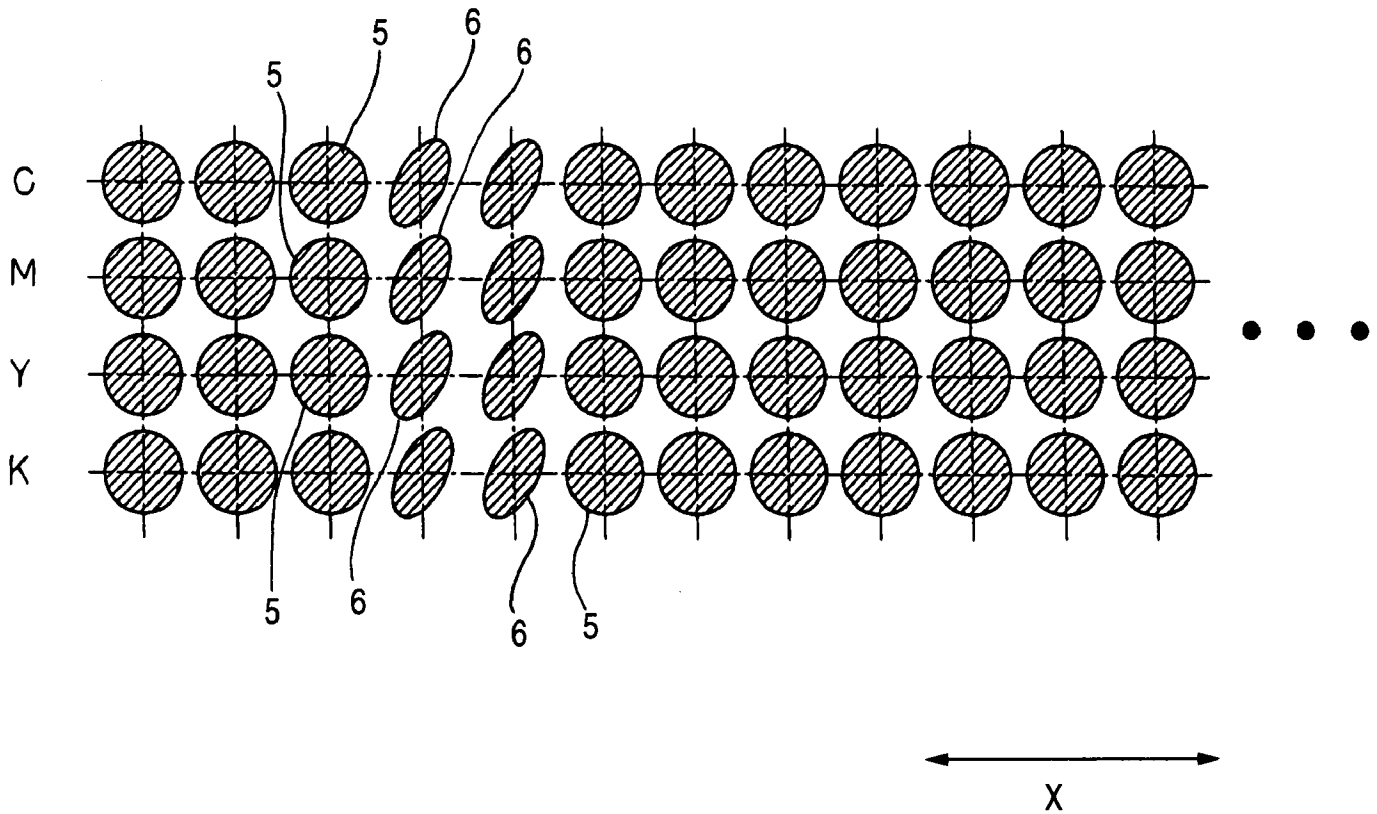
FIG. 26 is a diagram for explaining a manufacturing method of an optical writing device according to a sixteenth embodiment of the invention.

FIG. 26 shows light spots formed by the line heads of the respective colors in which the position adjustment in the first direction X has been completed. When light spots shapes 5 and 6 of cyan (C) in the first direction X are used as the reference, for the individual colors of magenta (M), yellow (Y), and black (K), the positions of the light spots 5 having normal sizes, and the positions of the light spots 6 having the larger sizes are aligned relative to the first direction X. For this reason, when color superposition of plural colors is performed, color fluctuation can be prevented from occurring.

Next, configuration examples of the line head 23 to which the invention of this embodiment is applicable will be described.

Figure 28:
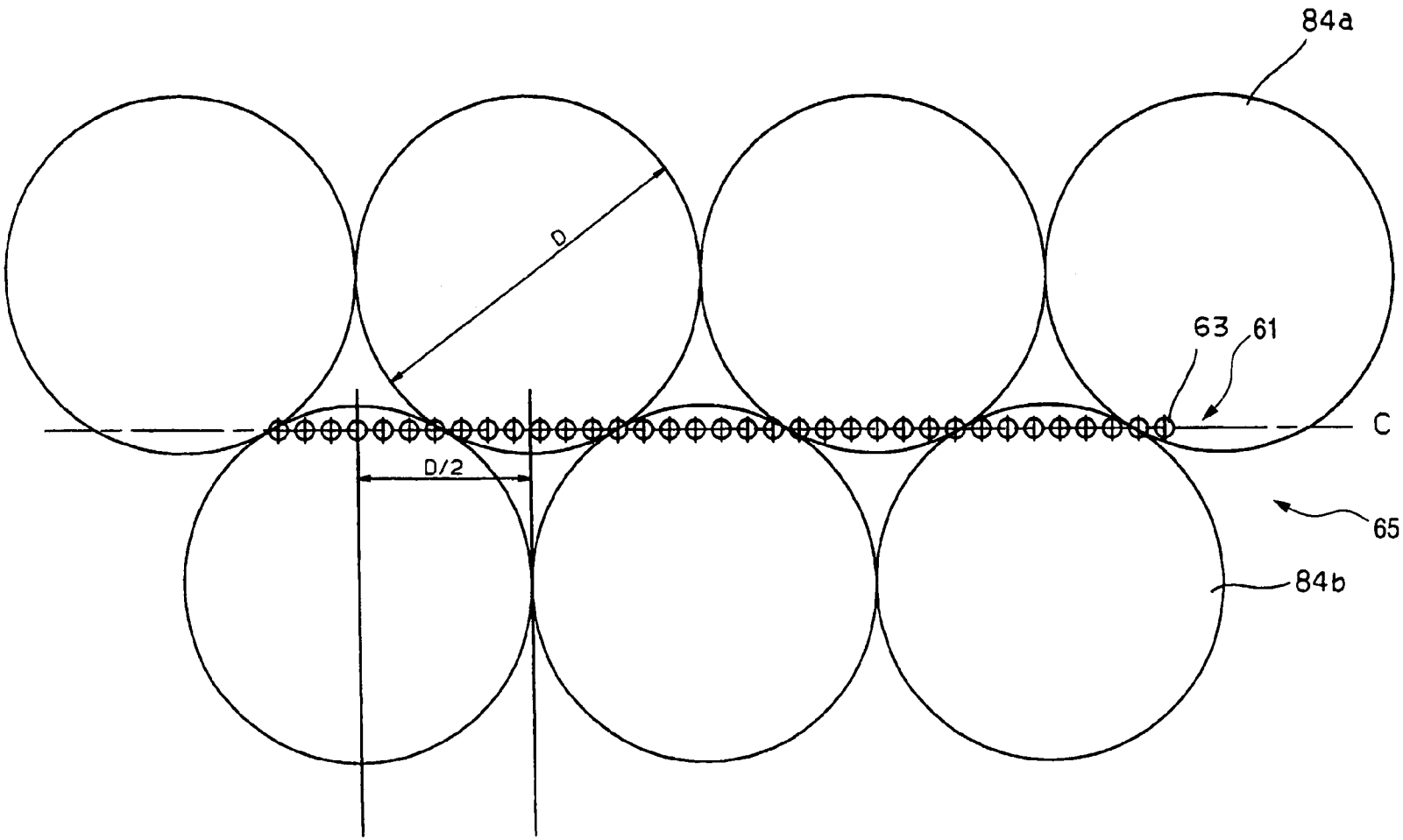
FIGS. 28 to 30 are diagrams showing examples of an optical writing device to which the manufacturing method of the sixteenth embodiment can be applied.

In an example shown in FIG. 28, a single photo emitter array 61 and two rod lens arrays 65 are arranged in the second direction Y. Reference numerals 84*a* and 84*b* denote rod lenses of the individual rod lens arrays 65. In this configuration, the light spot size is normally increased by a pitch of a radius (½)D of the rod lens 84*a*, 84*b*. In this case, as described above, by performing the alignment of the positions in the first direction X of the light spots having the larger sizes for the respective colors, color fluctuation at the time of color superposition of plural colors can be prevented from occurring. That is, image quality can be prevented from being degraded due to a difference in position in the first direction X caused by fluctuation in the light spot size.

Figure 29:
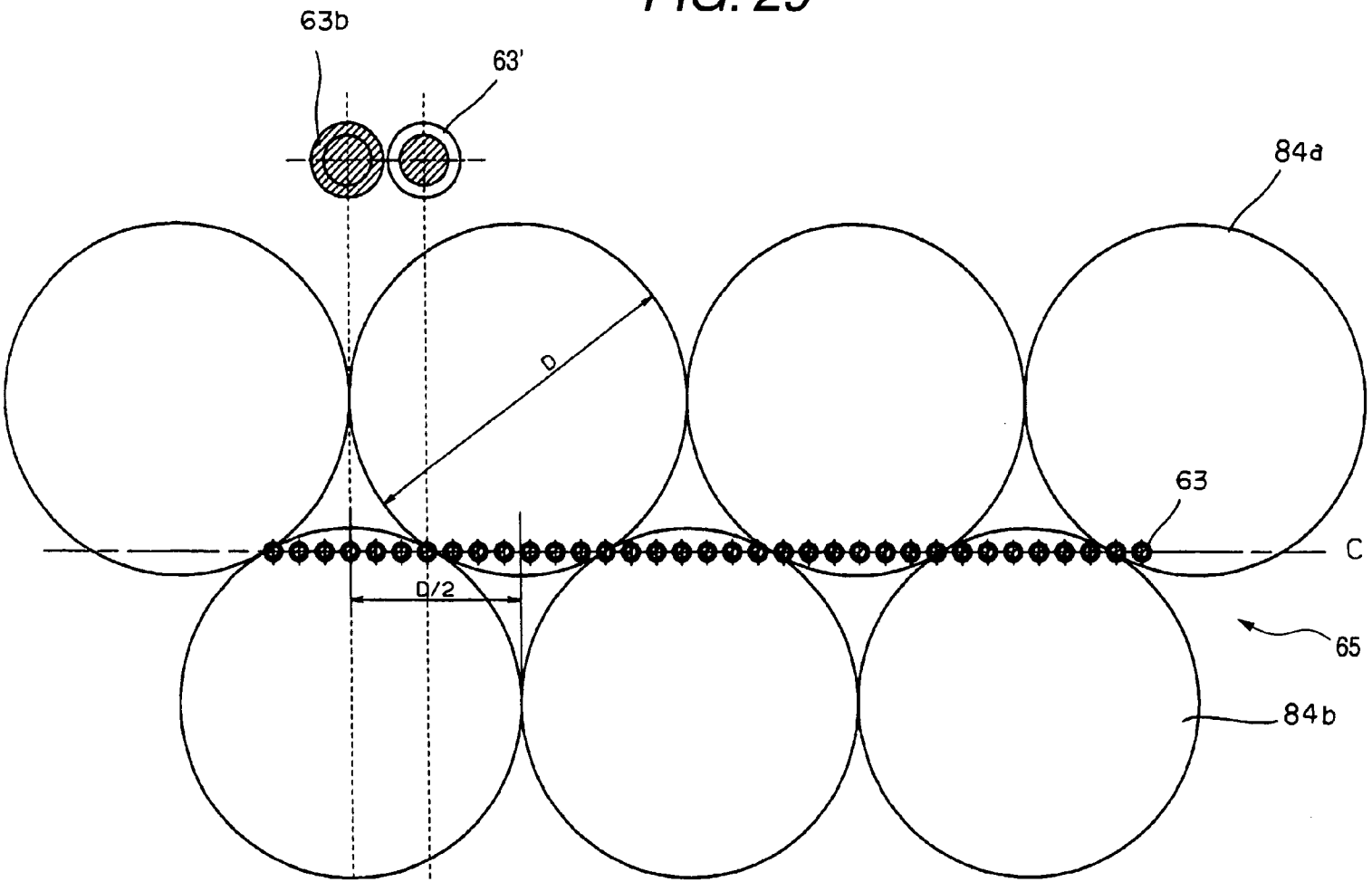

In an example shown in FIG. 29, one photo emitter array 61 and two rod lens arrays are arranged in the second direction Y. The photo emitter in this embodiment is capable of change a light emission area. Reference numeral 63 denotes a case where both of an inner light emission area and an outer light emission area are used. Reference numeral 63' denotes a case where only the inner light emission area is used. Also in this case, by performing the above described alignment, color fluctuation at the time of color superposition of plural colors can be prevented from occurring.

Figure 30:
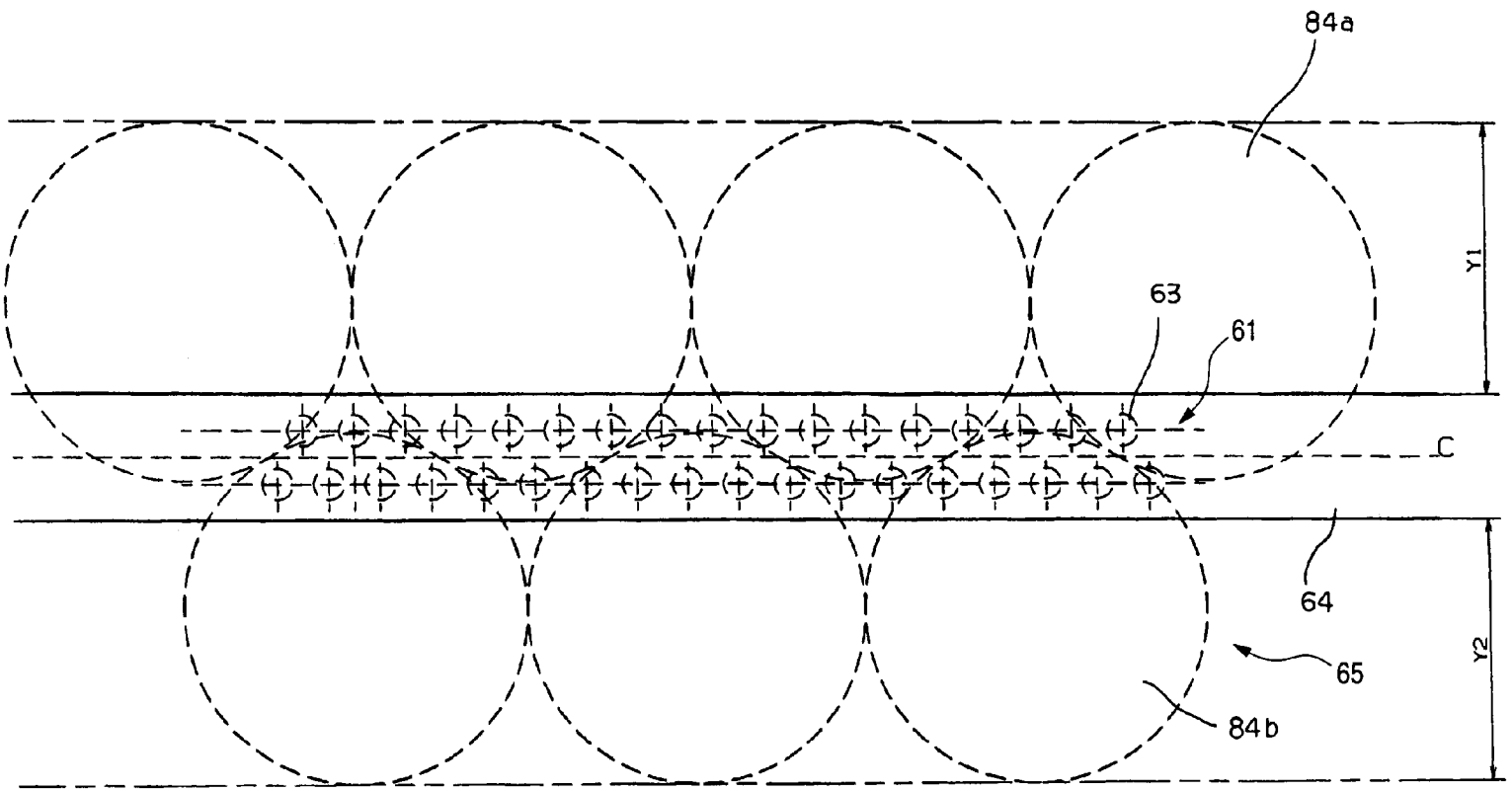
Figure 31:
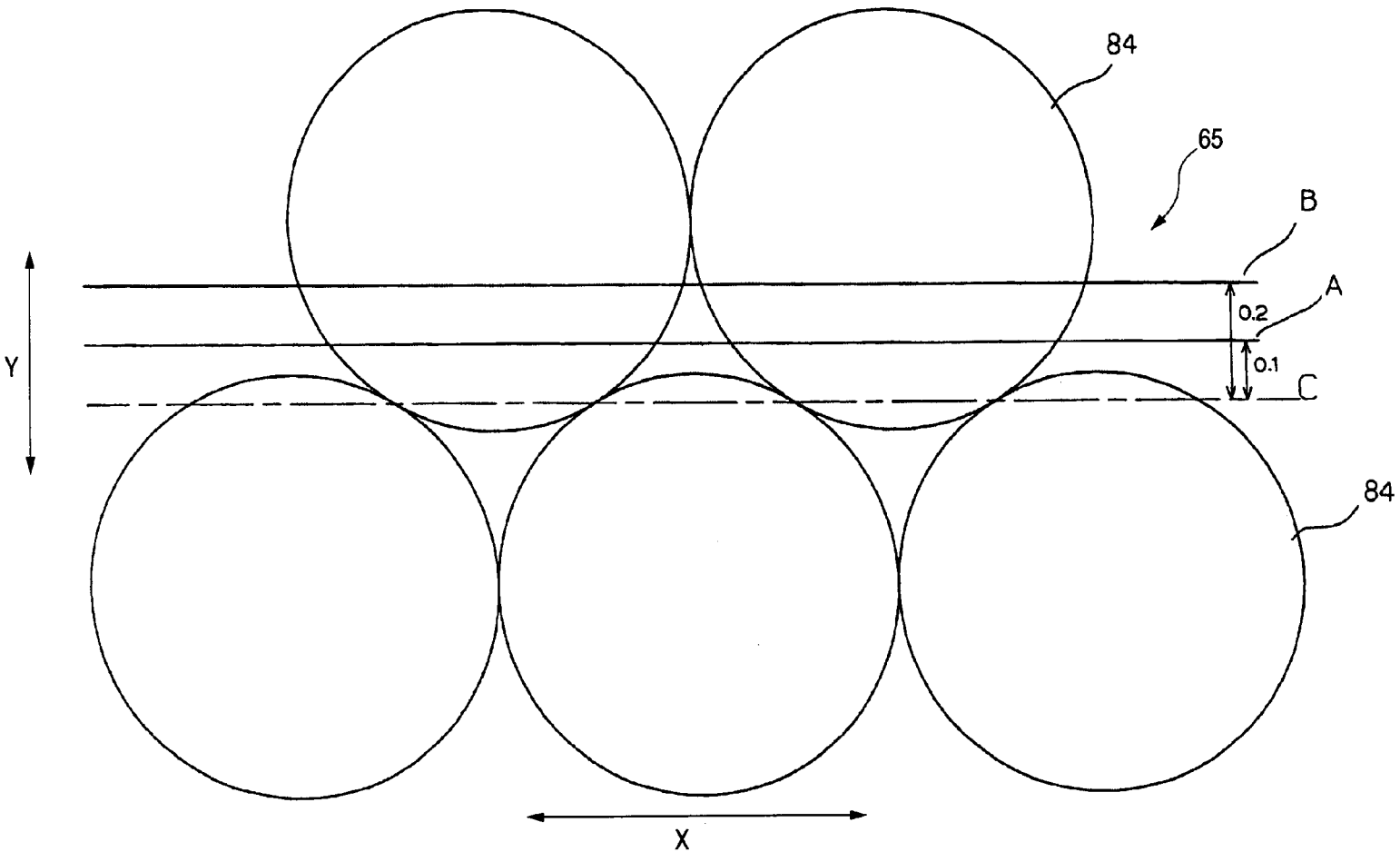
FIG. 31 is a diagram for explaining misalignment between a photo emitter array and rod lens arrays.
Figure 32A:
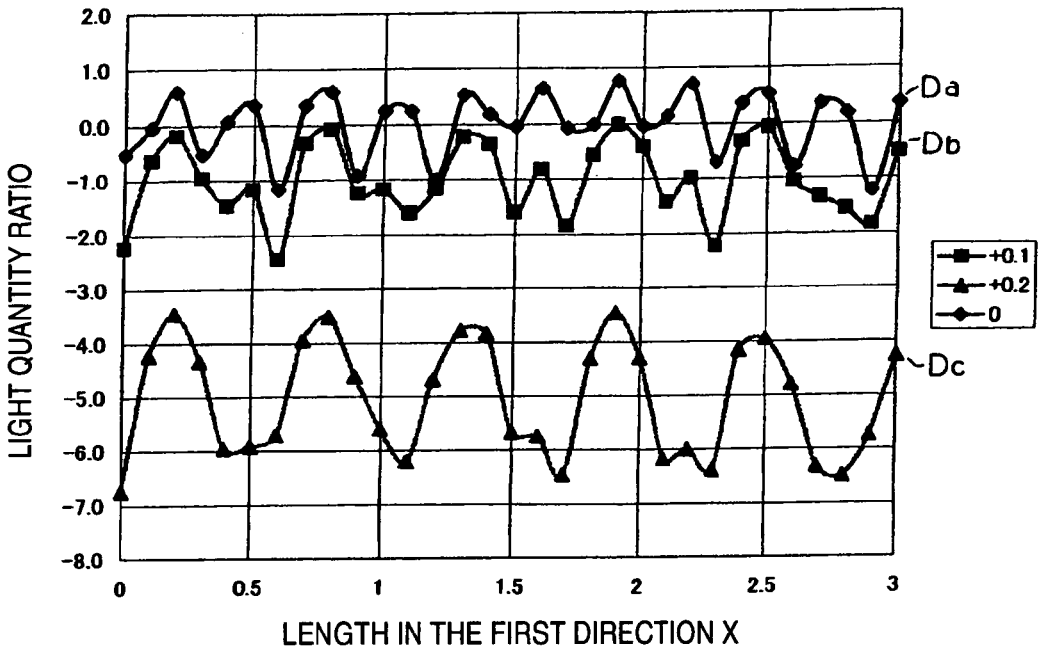
FIGS. 32A and 32B are graphs for explaining light amount variation caused by the misalignment.
Figure 32B:
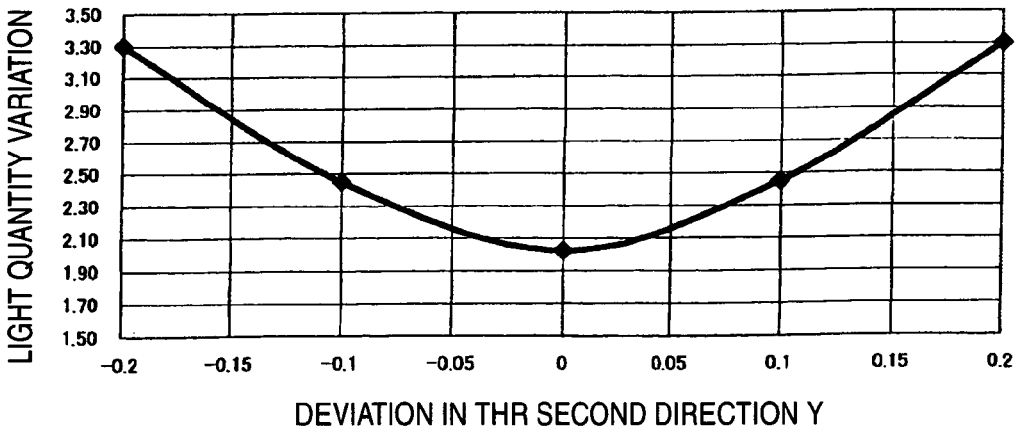

In an example shown in FIG. 30, two photo emitter arrays 61 and two rod lens arrays 65 are arranged in the second direction Y. Y1 is a length between one edge of the cover glass 64 and an external tangent of the rod lens 84*a*, and Y2 is a length between the other edge of the cover glass 64 and an external tangent of the rod lens 84*b*. In this case, the plurality of photo emitter arrays 61 are arranged in the second direction Y, and thus this configuration can be applied to various uses, such as multiple-exposure. Also in this case, by performing the above-described misalignment, color fluctuation at the time of color superposition of plural colors can be also prevented from occurring.

In the above examples, one or two photo emitter arrays 61 and one or two rod lens arrays 65 are arranged in the second direction Y. The combination of the number of photo emitter arrays 61 and the number of rod lens arrays 65 can be arbitrarily selected. Further, in case of a configuration in which three or more photo emitter arrays arranged in the second direction Y, the optical writing device can be applied to various uses, such as multiple-exposure and the like. When three or more photo emitter arrays in the second direction Y, one or two rod lens arrays can be suitably selected.

As described above, although the color image forming apparatus of the present invention is described on the basis of the embodiments, but the present invention is not limited to the embodiments, and various modifications can be made.

What is claimed is:

1. An optical writing device, comprising:

a transparent substrate;

a plurality of photo emitters, arrayed on the substrate in a first direction to form at least one photo emitter array; and a plurality of lenses, adopted to image light emitted from the photo emitters on a target surface, and arrayed in the first direction to form at least one lens array, wherein:

the photo emitters include first photo emitters each having a first dimension in the first direction and second photo emitters each having a second dimension in the first direction which is different from the first dimension;

a position of the second photo emitter depends on a relative position in the first direction with respect to the lens array; and the second photo emitters are arranged at an interval equal to a half of a diameter of the lens.

2. The optical writing device as set forth in claim 1, wherein the second dimension is smaller than the first dimension.

3. The optical writing device as set forth in claim 1, wherein a plurality of photo emitter arrays are arranged in a second direction perpendicular to the first direction.

4. The optical writing device as set forth in claim 1, wherein a plurality of lens arrays are arranged in a second direction perpendicular to the first direction.

5. The optical writing device as set forth in claim 1, wherein the photo emitters are organic EL elements.

* * * * *